US009606503B2

(12) United States Patent
Taguchi

(10) Patent No.: US 9,606,503 B2
(45) Date of Patent: Mar. 28, 2017

(54) CARTRIDGE

(71) Applicant: Brother Kogyo Kabushiki Kaisha, Nagoya-shi, Aichi-ken (JP)

(72) Inventor: Kazuna Taguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/670,522

(22) Filed: Mar. 27, 2015

(65) Prior Publication Data

US 2015/0277355 A1 Oct. 1, 2015

(30) Foreign Application Priority Data

Mar. 31, 2014 (JP) ..... 2014-074730

(51) Int. Cl.

| | |
|---|---|
| ***G03G 15/04*** | (2006.01) |
| ***G03G 21/16*** | (2006.01) |
| ***G03G 21/18*** | (2006.01) |
| *G03G 15/08* | (2006.01) |

(52) U.S. Cl.

CPC ..... *G03G 21/1647* (2013.01); *G03G 21/186* (2013.01); *G03G 21/1857* (2013.01); *G03G 21/1864* (2013.01); *G03G 21/1896* (2013.01); *G03G 15/0865* (2013.01); *G03G 2221/1657* (2013.01)

(58) Field of Classification Search

CPC ..... G03G 21/1647; G03G 21/1857; G03G 21/186; G03G 21/1864; G03G 15/0865; G03G 21/1896; G03G 2221/1657

See application file for complete search history.

(56) References Cited

U.S. PATENT DOCUMENTS

| | | | |
|---|---|---|---|
| 4,974,020 | A | 11/1990 | Takamatsu et al. |
| 5,053,816 | A | 10/1991 | Takahashi |
| 5,489,976 | A | 2/1996 | Ichikawa |

(Continued)

FOREIGN PATENT DOCUMENTS

| | | | |
|---|---|---|---|
| AU | 2010281279 | B2 | 2/2014 |
| CN | 1445624 | A | 10/2003 |

(Continued)

OTHER PUBLICATIONS

Feb. 27, 2014—(KR) Notice of Preliminary Rejection—App 10-2012-7028457.

(Continued)

*Primary Examiner* — Ryan Walsh

(74) *Attorney, Agent, or Firm* — Banner & Witcoff, Ltd.

(57) ABSTRACT

A cartridge including a housing configured to accommodate therein developer, a driving receiving part configured to receive a driving force, a first rotary member configured to rotate by a driving force transmitted from the driving receiving part, a conveyance member to which a driving force is configured to be transmitted by rotation of the first rotary member and configured to convey the developer, a second rotary member configured to rotate by a driving force transmitted from the driving receiving part, and a detected part configured to move by the rotation of the second rotary member, wherein the second rotary member is arranged to overlap with the first rotary member in an axis direction parallel with an axis of the first rotary member.

16 Claims, 16 Drawing Sheets

(56) References Cited

U.S. PATENT DOCUMENTS 5,495,323 A 2/1996 Meetze, Jr.
5,495,327 A 2/1996 Inomata
5,640,651 A 6/1997 Katoh et al.
5,649,264 A 7/1997 Domon et al.
5,970,293 A 10/1999 Huang
6,088,561 A 7/2000 Kawamura et al.
6,154,619 A 11/2000 Boockholdt et al.
6,714,224 B2 3/2004 Yamanaka et al.
6,792,217 B2 9/2004 Nishino et al.
6,823,160 B2 11/2004 Okabe
6,829,465 B2 12/2004 Yamanaka et al.
6,903,759 B2 6/2005 Yamanaka et al.
6,909,866 B2 6/2005 Kawai
6,920,303 B2 7/2005 Yamanaka et al.
7,116,919 B2 10/2006 Ishii
7,130,551 B2 10/2006 Kobayashi
7,418,214 B2 8/2008 Yoshida et al.
7,463,834 B2 12/2008 Takagi et al.
7,509,075 B2 3/2009 Hayakawa
7,512,347 B2 3/2009 Suzuki et al.
7,536,117 B2 5/2009 Kishi
7,613,414 B2 11/2009 Kamimura
7,643,777 B2 1/2010 Matsumoto et al.
7,756,426 B2 7/2010 Kamimura
7,933,536 B2 4/2011 Ogawa
7,953,330 B2 5/2011 Ishikawa
8,010,026 B2 8/2011 Kobayashi et al.
RE42,796 E 10/2011 Ishii
8,090,272 B2 1/2012 Ishikawa
8,099,025 B2 1/2012 Ishikake
8,126,366 B2 2/2012 Hattori
8,417,130 B2 4/2013 Hashimoto
8,463,145 B2 6/2013 Ukai et al.
8,583,009 B2 11/2013 Takagi
8,600,244 B2 12/2013 Hashimoto
8,620,180 B2 12/2013 Shiraki et al.
8,666,293 B2 3/2014 Mushika et al.
8,744,288 B2 6/2014 Shinoya et al.
8,761,643 B2 6/2014 Mushika et al.
8,849,133 B2 9/2014 Itabashi et al.
8,867,932 B2 10/2014 Ukai et al.
8,948,617 B2 2/2015 Shiraki et al.
8,948,661 B2 2/2015 Mushika et al.
9,195,207 B2 11/2015 Itabashi
9,207,567 B2 12/2015 Mushika et al.
2003/0185579 A1 10/2003 Nishino et al.
2003/0185594 A1 10/2003 Okabe
2003/0215265 A1 11/2003 Kawai
2006/0034625 A1 2/2006 Kajikawa
2006/0104670 A1 5/2006 Nishitani et al.
2006/0165423 A1 7/2006 Nishitani et al.
2006/0171737 A1 8/2006 Nishimura et al.
2006/0193643 A1 8/2006 Takagi et al.
2006/0193646 A1 8/2006 Suzuki et al.
2006/0245787 A1 11/2006 Ito et al.
2007/0031158 A1 2/2007 Kamimura
2007/0041747 A1 2/2007 Kim et al.
2007/0059018 A1 3/2007 Tokuda
2007/0059038 A1 3/2007 Shiraki
2007/0077101 A1* 4/2007 Tamura ..... G03G 15/0875 399/262
2007/0122165 A1 5/2007 Igarashi et al.
2007/0140709 A1 6/2007 Yoshida et al.
2007/0140725 A1 6/2007 Kamimura
2007/0253748 A1 11/2007 Matsumoto et al.
2008/0080904 A1 4/2008 Murayama et al.
2008/0205911 A1 8/2008 Ishikawa et al.
2008/0205928 A1 8/2008 Ishikawa
2008/0205931 A1 8/2008 Ishikawa
2008/0223173 A1 9/2008 Ishikawa
2008/0317509 A1 12/2008 Mori
2009/0000423 A1 1/2009 Ishikawa et al.
2009/0052911 A1 2/2009 Richey et al.
2009/0084210 A1 4/2009 Tsukada et al.
2009/0169247 A1 7/2009 Hattori
2009/0257782 A1 10/2009 Ishikake
2009/0269085 A1 10/2009 Ukai
2009/0269086 A1 10/2009 Mikuni
2009/0285604 A1 11/2009 Nakajima
2009/0297226 A1 12/2009 Nagashima et al.
2010/0054763 A1 3/2010 Tomiyori et al.
2010/0209144 A1 8/2010 Nieda
2011/0023368 A1 2/2011 Mizutani et al.
2011/0038649 A1 2/2011 Miyabe et al.
2011/0081163 A1 4/2011 Lee
2011/0123231 A1 5/2011 Ozawa et al.
2011/0236062 A1 9/2011 Takagi
2011/0236065 A1 9/2011 Takagi
2011/0236066 A1 9/2011 Takagi
2011/0243578 A1 10/2011 Ukai et al.
2012/0014713 A1 1/2012 Murakami et al.
2012/0051795 A1 3/2012 Mushika et al.
2012/0057905 A1 3/2012 Itabashi
2012/0134688 A1 5/2012 Hashimoto
2012/0148297 A1 6/2012 Peng et al.
2012/0177398 A1 7/2012 Takigawa
2012/0243882 A1 9/2012 Carot
2012/0251165 A1 10/2012 Mushika et al.
2012/0251216 A1 10/2012 Mushika
2012/0321345 A1 12/2012 Shinoya et al.
2013/0051813 A1 2/2013 Itabashi et al.
2013/0051814 A1 2/2013 Itabashi et al.
2013/0051815 A1 2/2013 Itabashi et al.
2013/0051816 A1 2/2013 Itabashi
2013/0051833 A1 2/2013 Itabashi et al.
2013/0084083 A1 4/2013 Itabashi et al.
2013/0136460 A1 5/2013 Shiraki et al.
2013/0170844 A1 7/2013 Itabashi
2013/0170845 A1 7/2013 Itabashi
2013/0259528 A1 10/2013 Yamamoto
2013/0272724 A1 10/2013 Ukai et al.
2014/0020489 A1 1/2014 Nozaki et al.
2014/0086638 A1 3/2014 Sato
2014/0169835 A1 6/2014 Nakajima
2014/0219690 A1 8/2014 Li et al.
2014/0294403 A1 10/2014 Shimizu
2014/0341617 A1 11/2014 Mushika et al.
2014/0363189 A1 12/2014 Hashimoto et al.
2014/0376968 A1 12/2014 Yamamoto et al.
2015/0000443 A1 1/2015 Shimizu
2015/0003844 A1 1/2015 Ukai et al.
2015/0005134 A1 1/2015 Shimizu
2015/0010334 A1 1/2015 Nakajima
2015/0037071 A1 2/2015 Yamamoto
2015/0043944 A1 2/2015 Yamamoto
2015/0104222 A1 4/2015 Mushika et al.
2015/0117873 A1 4/2015 Mori et al.
2015/0117906 A1 4/2015 Mori
2015/0153675 A1 6/2015 Itabashi et al.

FOREIGN PATENT DOCUMENTS

CN 1828447 A 9/2006
CN 1288515 C 12/2006
CN 2884266 Y 3/2007
CN 1983078 A 6/2007
CN 101063855 A 10/2007
CN 200962188 Y 10/2007
CN 101256379 A 9/2008
CN 101295157 A 10/2008
CN 201170840 Y 12/2008
CN 100476636 C 4/2009
CN 201222170 Y 4/2009
CN 101625537 B 1/2010
CN 201402371 Y 2/2010
CN 201464807 U 5/2010
CN 201489284 U 5/2010
CN 202102251 U 1/2012
CN 202472249 U 10/2012
CN 102799090 A 11/2012
CN 202649679 U 1/2013
CN 203673223 U 6/2014
EP 0838733 A2 4/1998
EP 1696278 A2 8/2006

(56) References Cited

FOREIGN PATENT DOCUMENTS

| | | | |
|---|---|---|---|
| EP | 1696278 | A3 | 8/2006 |
| EP | 1965268 | A1 | 9/2008 |
| EP | 1965274 | A2 | 9/2008 |
| EP | 1995644 | A2 | 11/2008 |
| EP | 2093619 | A1 | 8/2009 |
| EP | 2369422 | A1 | 9/2011 |
| EP | 2378378 | A2 | 10/2011 |
| EP | 2463723 | A1 | 6/2012 |
| EP | 2463723 | A4 | 6/2012 |
| EP | 2574991 | A2 | 4/2013 |
| EP | 2574992 | A2 | 4/2013 |
| EP | 2574993 | A2 | 4/2013 |
| HK | 1090991 | A1 | 11/2009 |
| JP | S5323696 | | 2/1978 |
| JP | S6183570 | A | 4/1986 |
| JP | S63-118042 | U | 7/1988 |
| JP | H01205175 | A | 8/1989 |
| JP | H02-78949 | U | 6/1990 |
| JP | H02-262168 | A | 10/1990 |
| JP | H03-212656 | A | 9/1991 |
| JP | H04-31156 | A | 2/1992 |
| JP | H04-31156 | U | 3/1992 |
| JP | H04-191773 | A | 7/1992 |
| JP | H04-112263 | U | 9/1992 |
| JP | H04-114057 | U | 10/1992 |
| JP | 5323696 | B2 | 12/1993 |
| JP | 06-208301 | A | 7/1994 |
| JP | H07-140776 | A | 6/1995 |
| JP | H07-281519 | | 10/1995 |
| JP | H08-179608 | A | 7/1996 |
| JP | H08-248838 | A | 9/1996 |
| JP | H09160466 | A | 6/1997 |
| JP | H09222783 | A | 8/1997 |
| JP | 2551714 | Y2 | 10/1997 |
| JP | H09-258634 | A | 10/1997 |
| JP | H10-301382 | A | 11/1998 |
| JP | H11-37169 | A | 2/1999 |
| JP | H11-52716 | A | 2/1999 |
| JP | 2000338760 | A | 12/2000 |
| JP | 2001-042585 | A | 2/2001 |
| JP | 2001-166648 | A | 6/2001 |
| JP | 3266779 | B2 | 3/2002 |
| JP | 2002-169449 | A | 6/2002 |
| JP | 2003-271039 | A | 9/2003 |
| JP | 2003295614 | A | 10/2003 |
| JP | 2003-337504 | A | 11/2003 |
| JP | 2004-045603 | B2 | 2/2004 |
| JP | 2005-241942 | A | 9/2005 |
| JP | 3710375 | B2 | 10/2005 |
| JP | 2006-235236 | A | 9/2006 |
| JP | 2006-243072 | A | 9/2006 |
| JP | 2006-267994 | A | 10/2006 |
| JP | 2007-079284 | A | 3/2007 |
| JP | 2007-164095 | A | 6/2007 |
| JP | 2007-199514 | A | 8/2007 |
| JP | 2008-089731 | A | 4/2008 |
| JP | 2008-216391 | A | 9/2008 |
| JP | 2008-216392 | A | 9/2008 |
| JP | 2008-216393 | A | 9/2008 |
| JP | 2008-216394 | A | 9/2008 |
| JP | 2008216919 | A | 9/2008 |
| JP | 2008299123 | A | 12/2008 |
| JP | 2008299124 | A | 12/2008 |
| JP | 2008299125 | A | 12/2008 |
| JP | 2009069177 | A | 4/2009 |
| JP | 2009-162915 | A | 7/2009 |
| JP | 2009-180983 | A | 8/2009 |
| JP | 4310703 | B2 | 8/2009 |
| JP | 2009-223017 | A | 10/2009 |
| JP | 2009-244560 | A | 10/2009 |
| JP | 2009244563 | A | 10/2009 |
| JP | 2009-276727 | A | 11/2009 |
| JP | 4372703 | B2 | 11/2009 |
| JP | 2009-282099 | A | 12/2009 |
| JP | 2009-288549 | A | 12/2009 |
| JP | 4376861 | B2 | 12/2009 |
| JP | 2011-013323 | A | 1/2011 |
| JP | 3167011 | U | 3/2011 |
| JP | 2011-215374 | A | 10/2011 |
| JP | 4859139 | B2 | 1/2012 |
| JP | 2012-053095 | A | 3/2012 |
| JP | 2012-108537 | A | 6/2012 |
| JP | 2012-194318 | A | 10/2012 |
| JP | 2012-212086 | A | 11/2012 |
| JP | 2012-233941 | A | 11/2012 |
| JP | 2013-011911 | A | 1/2013 |
| JP | 2013501253 | A | 1/2013 |
| JP | 2013054063 | A | 3/2013 |
| RU | 2011138921 | A | 9/2013 |
| WO | 2007062588 | A1 | 6/2007 |
| WO | 2011/015051 | A1 | 2/2011 |
| WO | 2013040989 | A1 | 3/2013 |
| WO | 2013073134 | A1 | 5/2013 |

OTHER PUBLICATIONS

Machine translation of JP 2006-235236 dated Jan. 9, 2014.
Jan. 5, 2012—(JP) Decision of Patent Grant—App 2010-083408.
Apr. 26, 2011—(WO) International Search Report (JPO)—App PCT/JP2011/057946.
Nov. 12, 2014—(US) Non-Final Office Action—U.S. Appl. No. 14/485,462.
Dec. 31, 2014—(CN) Notification of First Office Action—App 201310175410.5, Eng Tran.
Mar. 20, 2015—(US) Final Office Action—U.S. Appl. No. 14/485,462.
Mar. 27, 2015—(US) Co-pending U.S. Appl. No. 14/670,502.
Mar. 27, 2015—(US) Co-pending U.S. Appl. No. 14/670,676.
Decision to Grant a Patent issued in corresponding Japanese Patent Application No. 2010-193204 dated Sep. 18, 2012.
Notice of Reasons for Rejection issued in Japanese Patent Application No. 2012-229560 mailed Feb. 19, 2013.
Machine translation of JP 07-281519A dated May 2, 2013.
Machine translation of JP 10-031382A dated May 1, 2013.
Notice of Allowance received in U.S. Appl. No. 13/222,096 mailed Oct. 16, 2013.
Office Action received in related Chinese Patent Application No. 201110251898.6 mailed Oct. 15, 2013.
Notification of the First Office Action with Search Report issued in corresponding Chinese Patent Application No. 201110251898.6 dated Dec. 11, 2012.
Notice of Reasons for Rejection issued in corresponding Japanese Patent Application 2010-193204 mailed Jun. 26, 2012.
Notice of Allowance issued in corresponding U.S. Appl. No. 14/154,521 mailed Feb. 10, 2014.
Sep. 19, 2014—(US) Notice of Allowance—U.S. Appl. No. 14/275,251.
Mar. 19, 2015—(US) Non-Final Office Action—U.S. Appl. No. 14/577,396.
Co-pending U.S. Appl. No. 14/316,959, filed Jun. 27, 2014.
Co-Pending U.S. Appl. No. 14/316,971, filed Jun. 27, 2014.
Apr. 6, 2015—(US) Non-Final Office Action—U.S. Appl. No. 14/316,959.
Apr. 21, 2015—(EP) Extended Search Report—App 14173865.8.
May 8, 2015—Ex Parte Quayle—U.S. Appl. No. 14/316,971.
May 8, 2015—(US) Ex Parte Quayle—U.S. Appl. No. 14/316,971.
Mar. 3, 2015—(CN) Notification of First Office Action—App 201310175264.6, Eng Tran.
Mar. 3, 2015—(CN) Notification of First Office Action—App 201310175229.4, Eng Tran.
Sep. 17, 2015—(EP) Office Action—App 11160291.8.
Oct. 19, 2015—(US) Non-Final Office Action—U.S. Appl. No. 14/611,393.
Oct. 28, 2015—(US) Notice of Allowance—U.S. App. No. 14/316,959.
Nov. 27, 2015—(US) Non-Final Office Action—U.S. Appl. No. 14/670,502.
Dec. 14, 2015—(US) Non-Final Office Action—U.S. Appl. No. 14/926,345.

(56) References Cited

OTHER PUBLICATIONS

Dec. 17, 2015—(US) Non-Final Office Action—U.S. Appl. No. 14/670,676.
Jan. 20, 2016—(US) Notice of Allowance—U.S. Appl. No. 14/316,971.
Jan. 21, 2016—(US) Notice of Allowance—U.S. Appl. No. 14/485,462.
Aug. 19, 2015—(US) Non-Final Office Action—U.S. Appl. No. App 14/589,696.
Sep. 16, 2013—(US) Non-final office action—U.S. Appl. No. 13/431,077.
Sep. 6, 2013—(CN) Office Action—App 201210083604.8.
Mar. 27, 2014—(US) Notice of Allowance—U.S. Appl. No. 13/431,077.
May 1, 2015—(US) Non-Final Office Action—U.S. Appl. No. 14/491,157.
Dec. 24, 2015—(US) Notice of Allowance—U.S. Appl. No. 14/491,157.
Sep. 30, 2013—(CN) Office Action—App 201210083716.3.
Nov. 19, 2013—(JP) Office Action—App 2013-103770.
Jan. 8, 2014—(US) Notice of Allowance—U.S. Appl. No. 13/430,950.
May 27, 2014—(EP) Extended Search Report—App 12161226.1.
Feb. 4, 2015—(US) Notice of Allowance—U.S. Appl. No. 14/289,780.
Jan. 20, 2015—(JP) Notification of Reasons for Refusal—App 2014-042421, Eng Tran.
Jul. 16, 2012—(EP) Search Report—App 12157690.4.
Feb. 19, 2014—(US) Notice of Allowance—U.S. Appl. No. 13/431,074.
Jun. 19, 2014—(US) Non-final office action—U.S. Appl. No. 14/290,188.
Oct. 7, 2014—(US) Notice of Allowance—U.S. Appl. No. 14/290,188.
Aug. 21, 2015 (EP) Extended EP Search Report—App. No. 15161258.7.
Aug. 20, 2015—(EP) Extended EP Search Report in App No. 15161221.5.
Apr. 14, 2014 (US) Non-Final Office Action in U.S. Appl. No. 13/628,492.
Sep. 23, 2014—(US) Notice of Allowance—U.S. Appl. No. 13/628,492.
Apr. 15, 2015—(US) Notice of Allowance—U.S. Appl. No. 14/529,221.
Aug. 4, 2015—(US) Notice of Allowance—U.S. Appl. No. 14/577,396.
Aug. 25, 2015—(US) Non-Final Office Action—U.S. Appl. No. 14/671,413.
Jul. 22, 2015—(US) Non-Final Office Action—U.S. Appl. No. 14/316,971.
May 18, 2015—(US) Non-Final Office Action—U.S. Appl. No. 14/611,393.
Oct. 5, 2015—(US) Non-Final Office Action—U.S. Appl. No. 14/670,801.
Sep. 17, 2015—(EP) Office Action—App 11179283.4.
Sep. 17, 2015—(US) Non-Final Office Action—U.S. Appl. No. 14/670,489.
Sep. 23, 2015—(US) Notice of Allowance—U.S. Appl. No. 14/529,221.
Sep. 16, 2015—(US) Notice of Allowance—U.S. Appl. No. 14/485,462.
Feb. 25, 2016—(US) Non-Final Office Action—U.S. Appl. No. 14/316,959.
Feb. 2, 2016—(US) Notice of Allowance—U.S. Appl. No. 14/670,516.
Feb. 17, 2016—(US) Notice of Allowance—U.S. Appl. No. 14/671,413.
Feb. 18, 2016—(US) Notice of Allowance—U.S. Appl. No. 14/529,221.
Mar. 4, 2016—(US) Notice of Allowance—U.S. Appl. No. 14/491,157.
Mar. 29, 2016—(US) Notice of Allowance—U.S. Appl. No. 14/485,462.
Apr. 1, 2016—(US) Notice of Allowance—U.S. Appl. No. 14/926,345.
Apr. 12, 2016—(US) Notice of Allowance—U.S. Appl. No. 14/611,393.
Feb. 8, 2016—(EP) Extended European Search Report—App 15161221.5.
Sep. 23, 2015—(EP) Extended European Search Report—App 15161223.1.
Sep. 23, 2015—(EP) Extended European Search Report—App 15161224.9.
Sep. 25, 2015—(EP) Extended European Search Report—App 15161229.8.
Sep. 29, 2015—(EP) Extended European Search Report—App 15161242.1.
Apr. 26, 2016—(US) Non-Final Office Action—U.S. Appl. No. 15/079,829.
May 9, 2016—(US) Notice of Allowance—U.S. Appl. No. 14/670,489.
May 24, 2016—(US) Notice of Allowance—U.S. Appl. No. 14/485,462.
May 27, 2016—(US) Notice of Allowance—U.S. Appl. No. 14/671,413.
Jun. 10, 2016—(US) Notice of Allowance—U.S. Appl. No. 14/316,971.
Jun. 17, 2016—(US) Notice of Allowance—U.S. Appl. No. 14/926,345.
Jun. 17, 2016—(US) Notice of Allowance—U.S. Appl. No. 14/491,157.
Jun. 22, 2016—(US) Notice of Allowance—U.S. Appl. No. 14/670,516.
May 24, 2016—(EP) Communication—App 12157679.7.
Sep. 14, 2015—(EP) Communication—App 12157679.7.
May 24, 2016—(EP) Communication—App 12157690.4.
Sep. 11, 2015—(EP) Communication—App 12157690.4.
Jul. 16, 2012—(EP) Search Report 12157679.7.
Jun. 22, 2016—(US) Notice of Allowance—U.S. Appl. No. 14/529,221.
Apr. 16, 2013 (JP) Notice of Allowance—App. 2011100507.
Feb. 17, 2015 (JP) Notice of Allowance—App. 2011078637.
May 11, 2016—(EP) Communication—App 12161226.1.
Jun. 29, 2016—(US) Notice of Allowance—U.S. Appl. No. 14/611,393.
Jul. 11, 2016—(US) Non-Final Office Action—U.S. Appl. No. 14/670,502.
Jul. 14, 2016—(US) Notice of Allowance—U.S. Appl. No. 14/670,676.
Aug. 1, 2016—(US) Notice of Allowance—U.S. Appl. No. 14/670,516.
Aug. 9, 2016—(US) Notice of Allowance—U.S. Appl. No. 15/079,829.
Sep. 12, 2016—(US) Notice of Allowance—U.S. Appl. No. 14/589,696.
Sep. 28, 2016—(US) Notice of Allowance—U.S. Appl. No. 14/670,801.
Nov. 22, 2016—(JP) Office Action—App 2013137422—Eng Tran.
Dec. 13, 2016—(JP) Office Action—App 2014000609—Eng Tran.
Dec. 13, 2016—(JP) Office Action—App 2013137425—Eng Tran.
Dec. 12, 2016—(JP) Office Action—App 2014074727—Eng Tran.
Dec. 27, 2016—(JP) Office Action—App 2014074728—Eng Tran.
Dec. 27, 2016—(JP) Office Action—App 2014074729—Eng Tran.
Dec. 27, 2016—(JP) Office Action—App 2014074730—Eng Tran.

* cited by examiner

CARTRIDGE

CROSS-REFERENCE TO RELATED APPLICATIONS

This application claims priority from Japanese Patent Application No. 2014-074730 filed on Mar. 31, 2014, the entire contents of which are incorporated herein by reference.

TECHNICAL FIELD

Aspects of the disclosure relate to a cartridge configured to be mounted to an electrophotographic image forming apparatus.

BACKGROUND

As an electrophotographic printer, a printer to which a cartridge accommodating therein developer can be detachably mounted is known.

In the known printer, when a used cartridge is replaced with an unused cartridge, it is necessary to enable the printer to recognize that the unused cartridge has been mounted.

SUMMARY

It is therefore an object of the disclosure to provide a cartridge capable of enabling an external configuration to recognize that an unused cartridge has been mounted.

According to an aspect of the disclosure, there is provided a cartridge including a housing configured to accommodate therein developer, a driving receiving part configured to receive a driving force, a first rotary member configured to rotate by a driving force transmitted from the driving receiving part, a conveyance member to which a driving force is configured to be transmitted by rotation of the first rotary member and configured to convey the developer, a second rotary member configured to rotate by a driving force transmitted from the driving receiving part, and a detected part configured to move by the rotation of the second rotary member, wherein the second rotary member is arranged to overlap with the first rotary member in an axis direction parallel with an axis of the first rotary member.

DETAILED DESCRIPTION

1. Outline of Developing Cartridge

Figure 1:
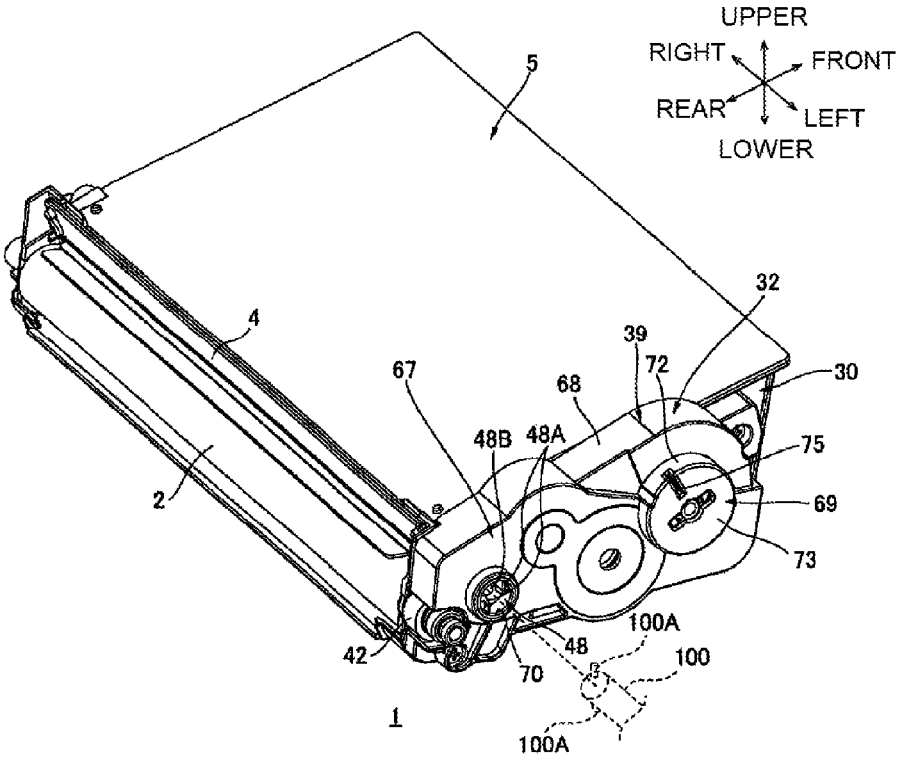
FIG. 1 is a perspective view of a developing cartridge according to an illustrative embodiment of the cartridge of the disclosure, as seen from a left-upper side.
Figure 2:
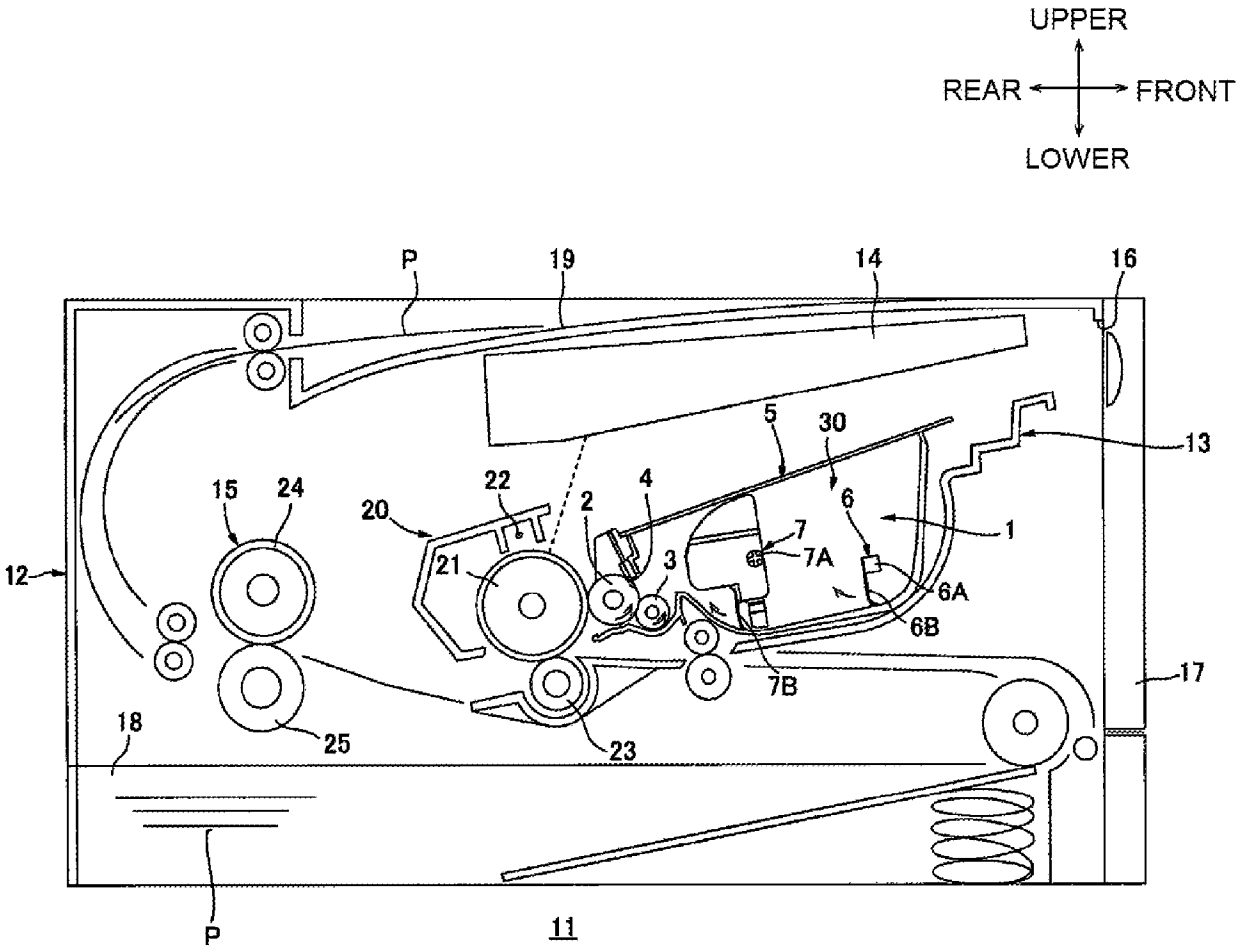
FIG. 2 is a central sectional view of a printer to which the developing cartridge of FIG. 1 is mounted.

As shown in FIGS. 1 and 2, a developing cartridge 1, which is an example of the cartridge, has a developing frame 5, which is an example of the housing, a developing roller 2, which is an example of the developer carrier, a supply roller 3, a layer thickness regulation blade 4, a first agitator 6, which is an example of the conveyance member, and a second agitator 7.

In the description hereinafter, when describing directions of the developing cartridge 1, a side at which the developing roller 2 is arranged is referred to as a rear side of the developing cartridge 1, and an opposite side thereof is referred to as a front side of the developing cartridge 1. Also, the left side and the right side are defined on the basis of a state where the developing cartridge 1 is seen from the front. Specifically, arrow directions indicated in the respective drawings are used as the basis. For example, in FIG. 2, as shown with the arrows, the right of the drawing sheet is the front of the developing cartridge 1, the left of the drawing sheet is the rear of the developing cartridge 1, the front side of the drawing sheet is the left, and the inner side of the drawing sheet is the right.

Also, a left-right direction is an example of the axis direction, a left side is an example of one side in the axis direction, and a right side is an example of the other side in the axis direction. A front-rear direction is an example of the first direction orthogonal to the axis direction, a front side is an example of one side in the first direction, and a rear side is an example of the other side in the first direction. An upper-lower direction is an example of the second direction orthogonal to both the axis direction and the first direction, an upper side is an example of one side in the second direction, and a lower side is an example of the other side in the second direction.

The developing frame 5 has a substantially box shape opening towards the rear side. The developing frame 5 is configured to accommodate therein toner, which is an example of the developer.

The developing roller 2 is rotatably supported to a rear end portion of the developing frame 5. A rear side of the developing roller 2 is exposed from the developing frame 5. The developing roller 2 has a substantially cylindrical shape extending in the left-right direction.

The supply roller 3 is arranged at a front-lower side of the developing roller 2 in the developing frame 5. The supply roller 3 is rotatably supported to the developing frame 5. The supply roller 3 has a substantially cylindrical shape extending in the left-right direction. The supply roller 3 contacts a front lower end portion of the developing roller 2.

The layer thickness regulation blade 4 is arranged at a front-upper side of the developing roller 2. The layer thickness regulation blade 4 contacts a front end portion of the developing roller 2.

The first agitator 6 is arranged at a front side in the developing frame 5. The first agitator 6 has a first agitator shaft 6A and a stirring blade 6B.

The first agitator shaft 6A has a substantially rod shape extending in the left-right direction. The stirring blade 6B is made of a film having flexibility. The stirring blade 6B is arranged at a rear-lower side with respect to the first agitator shaft 6A.

Figure 4A:
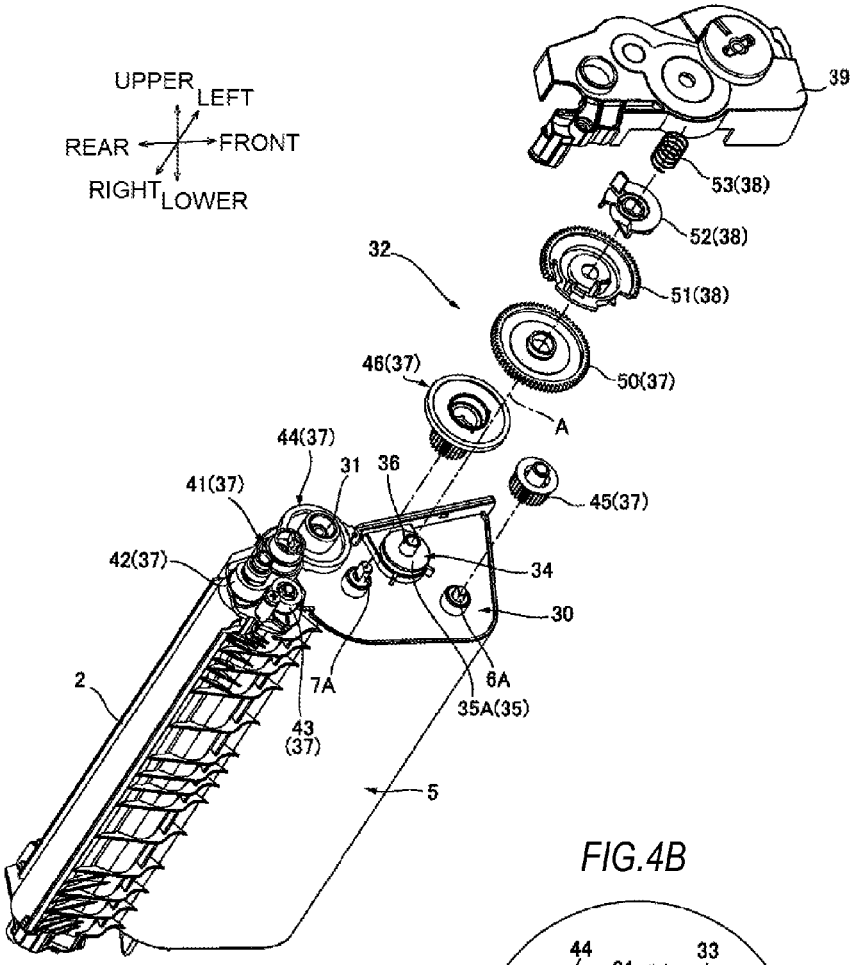
FIG. 4A is an exploded perspective view of a driving unit of the developing cartridge shown in FIG. 3A, as seen from a left-lower side.

Both left and right end portions of the first agitator shaft 6A are rotatably supported to a pair of sidewalls 30 (which will be described later), so that the first agitator 6 is supported to the developing frame 5. Also, as shown in FIG. 4A, the left end portion of the first agitator shaft 6A protrudes leftward from the left sidewall 30 (which will be described later).

As shown in FIG. 2, the second agitator 7 is arranged at an interval from the rear of the first agitator 6 in the developing frame 5. The second agitator 7 has a second agitator shaft 7A and a stirring blade 7B.

The second agitator shaft 7A has a substantially rod shape extending in the left-right direction. The stirring blade 7B consists of a film having flexibility. The stirring blade 7B is arranged at a rear-lower side with respect to the second agitator shaft 7A. That is, a relative positional relation between the first agitator shaft 6A and the stirring blade 6B and a relative positional relation between the second agitator shaft 7A and the stirring blade 7B are substantially the same.

Both left and right end portions of the second agitator shaft 7A are rotatably supported to the pair of sidewalls 30 (which will be described later), so that the second agitator 7 is supported to the developing frame 5. Also, as shown in FIG. 4A, the left end portion of the second agitator shaft 7A protrudes leftward from the left sidewall 30 (which will be described later).

2. Using Aspects of Developing Cartridge

As shown in FIG. 2, the developing cartridge 1 is used while being mounted to a printer 11.

The printer 11 is an electrophotographic image forming apparatus. More specifically, the printer 11 is a monochrome printer. The printer 11 has an apparatus main body 12, which is an example of the external configuration, a process cartridge 13, a scanner unit 14, and a fixing unit 15.

The apparatus main body 12 has a substantially box shape. The apparatus main body 12 has an opening 16, a front cover 17, a sheet feeding tray 18, and a sheet discharge tray 19.

The opening 16 is arranged at a front end portion of the apparatus main body 12. The opening 16 enables an inside and an outside of the apparatus main body 12 to communicate with each other so that the process cartridge 13 can pass therethrough.

The front cover 17 is arranged at the front end portion of the apparatus main body 12. The front cover 17 has a substantially plate shape extending in the upper-lower direction. The front cover 17 is swingably supported to a front wall of the apparatus main body 12 at a lower end portion thereof serving as a support point. The front cover 17 is configured to open or close the opening 16.

The sheet feeding tray 18 is arranged at a bottom of the apparatus main body 12. The sheet feeding tray 18 is configured to accommodate therein sheets P.

The sheet discharge tray 19 is arranged at a rear side of an upper wall of the apparatus main body 12. The sheet discharge tray 19 is recessed downwardly from an upper surface of the apparatus main body 12 so that the sheet P can be placed thereon.

The process cartridge 13 is accommodated at a substantially center of the apparatus main body 12. The process cartridge 13 is configured to be mounted to or to be demounted from the apparatus main body 12. The process cartridge 13 has a drum cartridge 20, and the developing cartridge 1.

The drum cartridge 20 has a photosensitive drum 21, a scorotron-type charger 22, and a transfer roller 23.

The photosensitive drum 21 is rotatably supported to a rear end portion of the drum cartridge 20.

The scorotron-type charger 22 is arranged at an interval from the photosensitive drum 21 at a rear-upper side of the photosensitive drum 21.

The transfer roller 23 is arranged below the photosensitive drum 21. The transfer roller 23 contacts a lower end portion of the photosensitive drum 21.

The developing cartridge 1 is configured to be mounted to or demounted from the drum cartridge 20. The developing cartridge 1 is mounted to the drum cartridge 20 so that the developing roller 2 contacts a front end portion of the photosensitive drum 21 at the front of the photosensitive drum 21.

The scanner unit 14 is arranged above the process cartridge 13. The scanner unit 14 is configured to emit a laser beam based on image data towards the photosensitive drum 21.

The fixing unit 15 is arranged at the rear of the process cartridge 13. The fixing unit 15 has a heating roller 24, and a pressing roller 25. The pressing roller 25 contacts a lower end portion of the heating roller 24.

The printer 11 starts an image forming operation under control of a control unit 93, which will be described later. Then, the scorotron-type charger 22 uniformly charges a surface of the photosensitive drum 21. The scanner unit 14 exposes the surface of the photosensitive drum 21. Thereby, an electrostatic latent image based on the image data is formed on the surface of the photosensitive drum 21.

Also, the first agitator 6 and the second agitator 7 stir the toner in the developing frame 5, thereby supplying the same to the supply roller 3. The supply roller 3 supplies the toner supplied by the first agitator 6 and second agitator 7 to the developing roller 2. At this time, the toner is positively friction-charged between the developing roller 2 and the supply roller 3, and is then carried on the developing roller 2. The layer thickness regulation blade 4 regulates a layer thickness of the toner carried on the developing roller 2 to a predetermined thickness.

The toner carried on the developing roller 2 is supplied to the electrostatic latent image on the surface of the photosensitive drum 21. Thereby, a toner image is carried on the surface of the photosensitive drum 21.

The sheet P is fed one by one at predetermined timing from the sheet feeding tray 18 towards between the photosensitive drum 21 and the transfer roller 23 by rotations of a variety of rollers. The toner image on the surface of the photosensitive drum 21 is transferred to the sheet P when the sheet P passes between the photosensitive drum 21 and the transfer roller 23.

Thereafter, the sheet P is heated and pressed while it passes between the heating roller 24 and the pressing roller 25. Thereby, the toner image on the sheet P is heat-fixed on the sheet P. Then, the sheet P is discharged to the sheet discharge tray 19.

3. Details of Developing Cartridge

As shown in FIG. 1, the developing cartridge 1 has a driving unit 32 arranged at the left side of the developing frame 5.

(i) Developing Frame

The developing frame 5 has a pair of sidewalls 30. The pair of sidewalls 30 is left and right end portions of the developing frame 5. The sidewall 30 has a substantially rectangular plate shape extending in the front-rear direction, as seen from above.

Figure 4B:
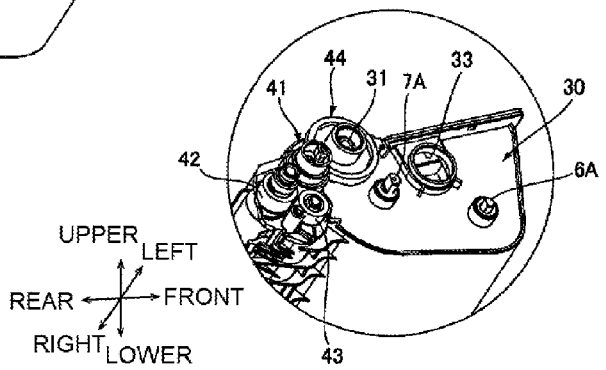
FIG. 4B is a perspective view of a developing frame shown in FIG. 4A with a toner cap being detached, as seen from a left-lower side.

As shown in FIGS. 4A and 4B, the left sidewall 30 of the pair of sidewalls 30 has an idle gear support shaft 31, a toner filling port 33, and a toner cap 34.

The idle gear support shaft 31 is arranged at a substantially center of an upper end portion of the left sidewall 30 in the front-rear direction. The idle gear support shaft 31 has a substantially cylindrical shape extending leftward from the left sidewall 30. The idle gear support shaft 31 is formed integrally with the left sidewall 30.

As shown in FIG. 4B, the toner filling port 33 is arranged at a substantially center of the left sidewall 30 in the front-rear direction. The toner filling port 33 has a substantially circular shape, in a side view, and penetrates the left sidewall 30 in the left-right direction.

As shown in FIG. 4A, the toner cap 34 is fitted in the toner filling port 33 to close the toner filling port 33. The toner cap 34 is made of a resin such as polyethylene and the like, and has a cap main body 35, and a support shaft 36, which is an example of the support part.

Figure 8:
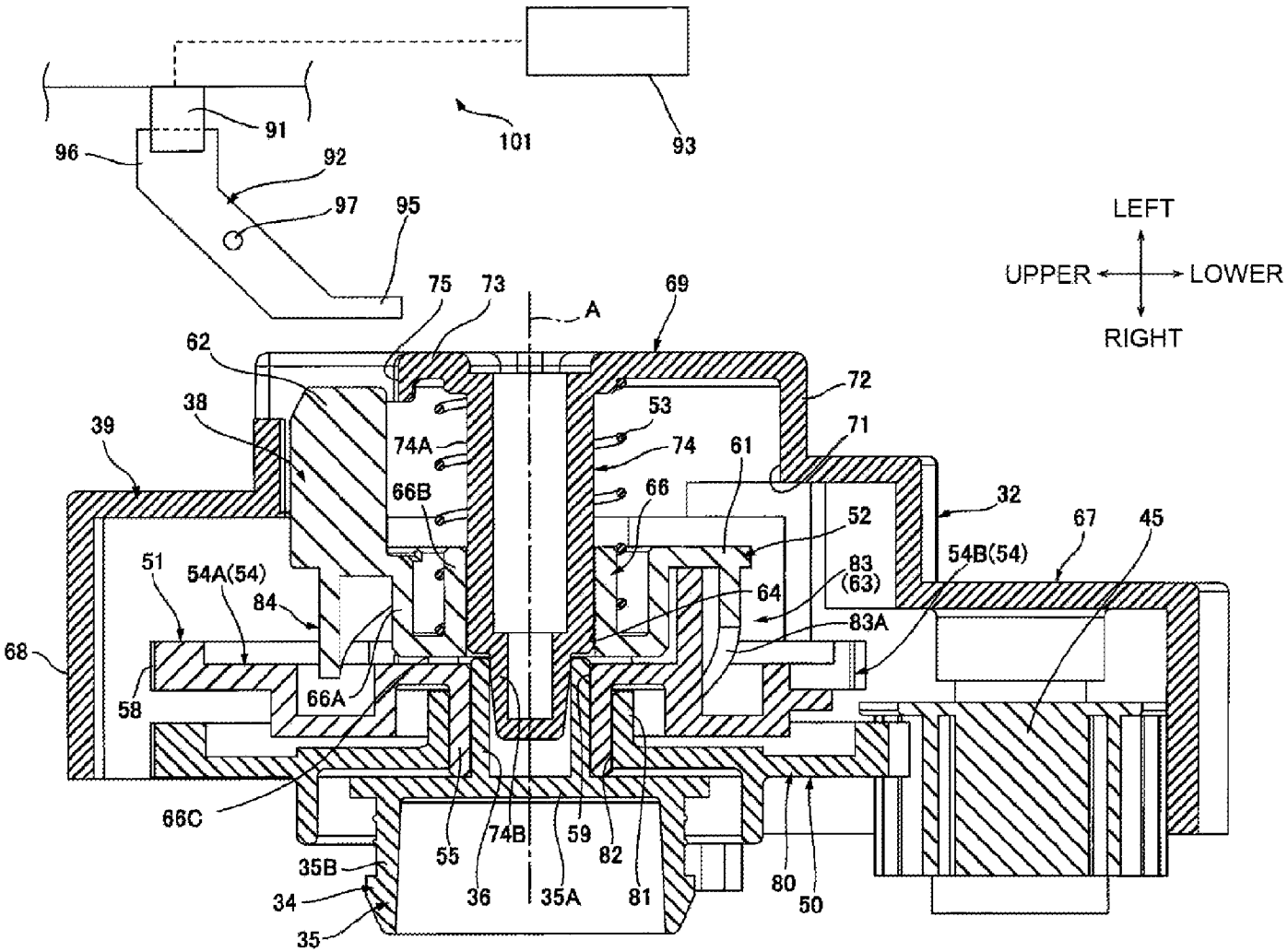
FIG. 8 is a sectional view taken along a line A-A of FIG. 7A, illustrating the detection unit and an idle gear shown in FIG. 7A.

As shown in FIG. 8, the cap main body 35 has a substantially cylindrical shape extending in the left-right direction and a left end portion thereof is closed. The cap main body 35 has a closing part 35A and an insertion part 35B.

As shown in FIG. 4A, the closing part 35A is a left end portion of the cap main body 35 and has a substantially circular plate shape, in a side view. An outer diameter of the closing part 35A is greater than an inner diameter of the toner filling port 33. As shown in FIG. 8, the insertion part 35B has a substantially cylindrical shape extending in the left-right direction, and extends rightward from a right surface of the closing part 35A. An outer diameter of the insertion part 35B is smaller than the outer diameter of the closing part 35A and slightly greater than the inner diameter of the toner filling port 33. The insertion part 35B is inserted in the toner filling port 33.

As shown in FIG. 4A, the support shaft 36 has a substantially cylindrical shape extending in the left-right direction, and protrudes leftward from a diametrical center of the left surface of the closing part 35A. That is, a left end portion of the support shaft 36 is opened.

(ii) Driving Unit

Figure 3A:
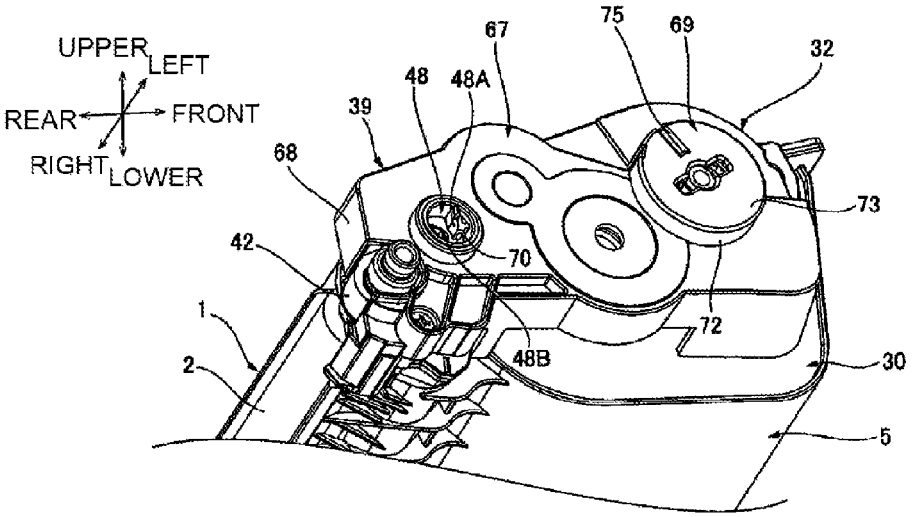
FIG. 3A is a perspective view of the developing cartridge shown in FIG. 1, as seen from a left-lower side.
Figure 3B:
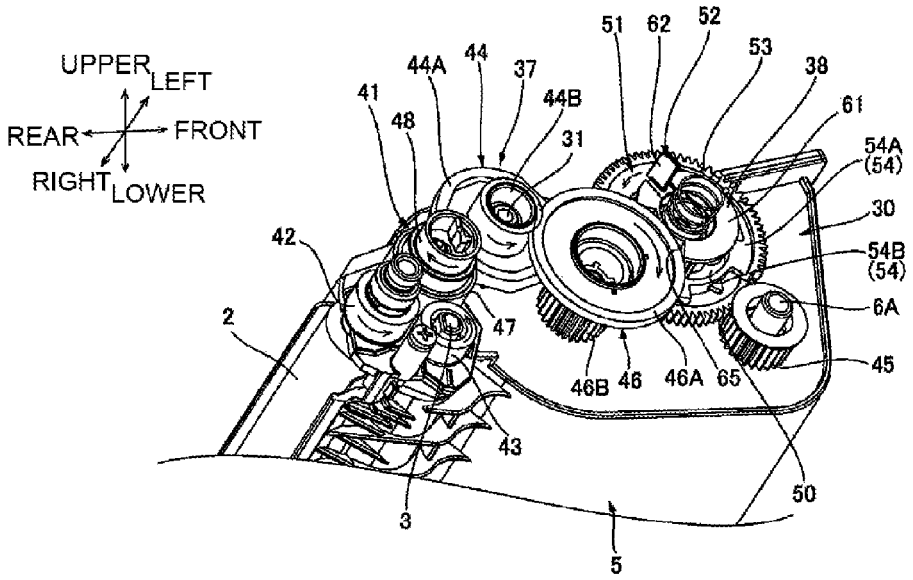
FIG. 3B is a perspective view of the developing cartridge shown in FIG. 3A with a gear cover being detached, as seen from a left-lower side.

As shown in FIGS. 3A, 3B and 4A, the driving unit 32 is arranged on the left surface of the left sidewall 30. The driving unit 32 has a gear train 37, a detection unit 38, and a gear cover 39.

(ii-1) Gear Train

As shown in FIG. 3B, the gear train 37 has a developing coupling 41, which is an example of the driving receiving part, a developing gear 42, a supply gear 43, a connection gear 44, a second agitator gear 46, which is an example of the fourth rotary member, an idle gear 50, which is an example of the first rotary member, and a first agitator gear 45, which is an example of the third rotary member.

The developing coupling 41 is rotatably supported to the left sidewall 30 at a rear end portion of the left sidewall 30. Specifically, the developing coupling 41 is rotatably supported to a support shaft (not shown) integrally provided to the left sidewall 30. The developing coupling 41 has a substantially cylindrical shape extending in the left-right direction. The developing coupling 41 integrally has a gear part 47 and a coupling part 48.

The gear part 47 is a right part of the developing coupling 41. The gear part 47 has a substantially cylindrical shape extending in the left-right direction and a left end portion thereof is closed. The gear part 47 has gear teeth over an entire circumference thereof.

The coupling part 48 is a left part of the developing coupling 41. The coupling part 48 has a substantially cylindrical shape having an opened left end portion, and extends leftward from a left end surface of the gear part 47. A central axis of the coupling part 48 coincides with a central axis of the gear part 47. As shown in FIG. 1, the coupling part 48 has a pair of protrusions 48A.

The pair of protrusions 48A is respectively arranged at an interval from each other in a diametrical direction of the coupling part 48 in an inner space 48B of the coupling part 48 in the diametrical direction. Each of the pair of protrusions 48A protrudes inward, in the diametrical direction, from an inner peripheral surface of the coupling part 48, and has a substantially rectangular shape, in a side view.

As shown in FIG. 3B, the developing gear 42 is supported to a left end portion of a rotary shaft of the developing roller 2 at a rear-lower side of the developing coupling 41 so that it cannot be relatively rotated. The developing gear 42 has a substantially cylindrical shape extending in the left-right direction. The developing gear 42 has gear teeth over an entire circumference thereof. The developing gear 42 is engaged with a rear lower end portion of the gear part 47 of the developing coupling 41.

The supply gear 43 is supported to a left end portion of a rotary shaft of the supply roller 3 below the developing coupling 41 so that it cannot be relatively rotated. The supply gear 43 has a substantially cylindrical shape extending in the left-right direction. The supply gear 43 has gear teeth over an entire circumference thereof. The supply gear 43 is engaged with a lower end portion of the gear part 47 of the developing coupling 41.

The connection gear 44 is rotatably supported to the idle gear support shaft 31 at a front-upper side of the developing coupling 41. The connection gear 44 integrally has a large diameter gear 44A and a small diameter gear 44B.

The large diameter gear 44A is a right part of the connection gear 44. The large diameter gear 44A has a substantially disc shape having a thickness in the left-right direction. The large diameter gear 44A has gear teeth over an entire circumference thereof. The large diameter gear 44A is engaged with a front upper end portion of the gear part 47 of the developing coupling 41.

The small diameter gear 44B is a left part of the connection gear 44. The small diameter gear 44B has a substantially cylindrical shape and extends leftward from a left surface of the large diameter gear 44A. A central axis of the small diameter gear 44B coincides with a central axis of the large diameter gear 44A. An outer diameter of the small diameter gear 44B is smaller than an outer diameter of the large diameter gear 44A. The small diameter gear 44B has gear teeth over an entire circumference thereof.

Figure 7A:
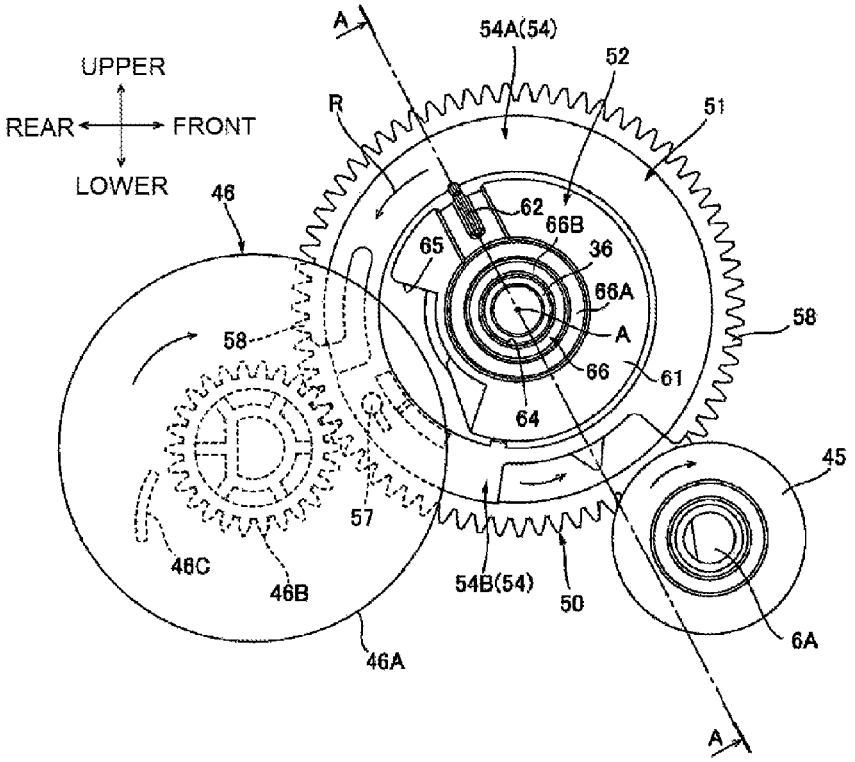
FIG. 7A is a left side view of a detection unit, the toothless gear, a first agitator gear and a second agitator gear shown in FIG. 3B.

As shown in FIG. 4A, the second agitator gear 46 is supported to a left end portion of the second agitator shaft 7A at a front-lower side of the connection gear 44 so that it cannot be relatively rotated. As shown in FIGS. 3B and 7A, the second agitator gear 46 has a first gear part 46A, a second gear part 46B, and an abutment rib 46C, which is an example of the first abutment part.

As shown in FIG. 3B, the first gear part 46A is a left part of the second agitator gear 46. The first gear part 46A has a substantially disc shape having a thickness in the left-right direction. The first gear part 46A has gear teeth over an entire circumference thereof. The first gear part 46A is engaged with a front lower end portion of the small diameter gear 44B of the connection gear 44.

The second gear part 46B is a right part of the second agitator gear 46. The second gear part 46B has a substantially cylindrical shape and extends rightward from a right surface of the first gear part 46A. A central axis of the second gear part 46B coincides with a central axis of the first gear part 46A. An outer diameter of the second gear part 46B is smaller than an outer diameter of the first gear part 46A. The second gear part 46B has gear teeth over an entire circumference thereof.

As shown in FIG. 7A, the abutment rib 46C is arranged at a rear-lower side of the second gear part 46B on a right surface of the first gear part 46A at a diametrical interval from the second gear part 46B. The abutment rib 46C has a substantially plate shape and protrudes rightwards from the right surface of the first gear part 46A. The abutment rib 46C extends so that it is inclined in a counterclockwise direction towards an outer side of the first gear part 46A in the diametrical direction, as seen from the left side.

The idle gear 50 is arranged at a front-upper side with respect to the second agitator gear 46. As shown in FIG. 8, the idle gear 50 integrally has a gear main body 80 and a gear collar 81.

The gear main body 80 has a substantially disc shape having a thickness in the left-right direction. The gear main body 80 has gear teeth over an entire circumference thereof. The gear main body 80 has an insertion hole 82.

The insertion hole 82 is arranged at a diametrical center of the gear main body 80. The insertion hole 82 has a substantially circular shape, in a side view, and penetrates the gear main body 80 in the left-right direction. An inner diameter of the insertion hole 82 is greater than an outer diameter of the support shaft 36.

The gear collar 81 is arranged on a left surface of the gear main body 80. The gear collar 81 has a substantially cylindrical shape extending in the left-right direction and protrudes leftward from a peripheral edge of the insertion hole 82 of the gear main body 80. An inner diameter of the gear collar 81 is substantially the same as the inner diameter of the insertion hole 82.

Figure 7B:
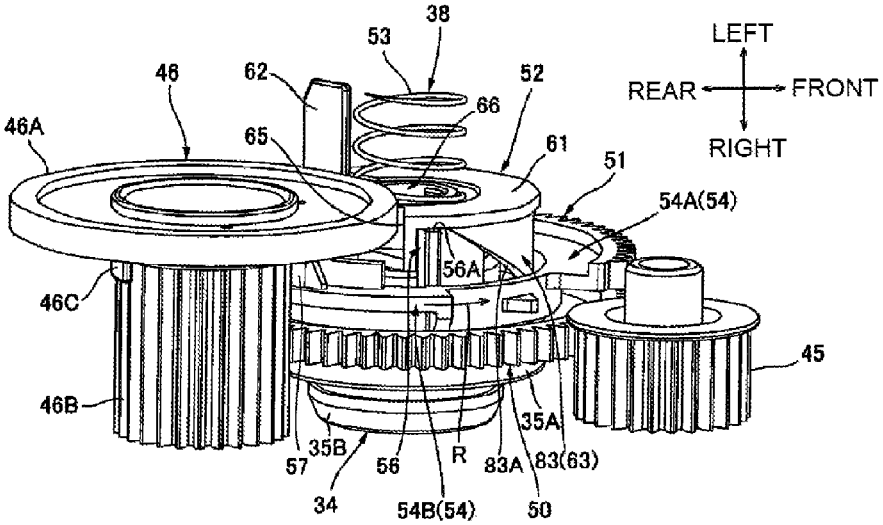
FIG. 7B is a perspective view of the detection unit, the toothless gear, the first agitator gear and the second agitator gear shown in FIG. 7A, as seen from a left-lower side, illustrating a state where the detection member is located at a retreat position.

The insertion hole 82 and the gear collar 81 accommodates the support shaft 36, so that the idle gear 50 is rotatably supported to the support shaft 36 through a collar part 55 (which will be described later). Also, as shown in FIG. 7B, the gear main body 80 of the idle gear 50 is engaged with a front upper end portion of the second gear part 46B of the second agitator gear 46. Thereby, the idle gear 50 is configured to contact the second gear part 46B over an entire circumference thereof.

As shown in FIG. 7A, the first agitator gear 45 is supported to a left end portion of the first agitator shaft 6A at a front-lower side of the idle gear 50 so that it cannot be relatively rotated. The first agitator gear 45 has a substantially cylindrical shape extending in the left-right direction. An outer diameter of the first agitator gear 45 is substantially the same as an outer diameter of the second gear part 46B of the second agitator gear 46. The first agitator gear 45 has gear teeth over an entire circumference thereof. The number of the gear teeth provided to the first agitator gear 45 is the same as the number of the gear teeth provided to the second gear part 46B. The first agitator gear 45 meshes with a front lower end portion of the gear main body 80 of the idle gear 50.

(ii-2) Detection Unit

As shown in FIG. 4A, the detection unit 38 is arranged at a left side with respect to the idle gear 50. The detection unit 38 has a toothless gear 51, which is an example of the second rotary member, a detection member 52, which is an example of the detected member, and a compression spring 53.

The toothless gear 51 is formed of a resin material having higher wear resistance than the toner cap 34, specifically, polyacetal resin. The toothless gear 51 is arranged at the left of the idle gear 50, i.e., is closely arranged at an opposite side of the left sidewall 30 with respect to the idle gear 50.

Figure 5A:
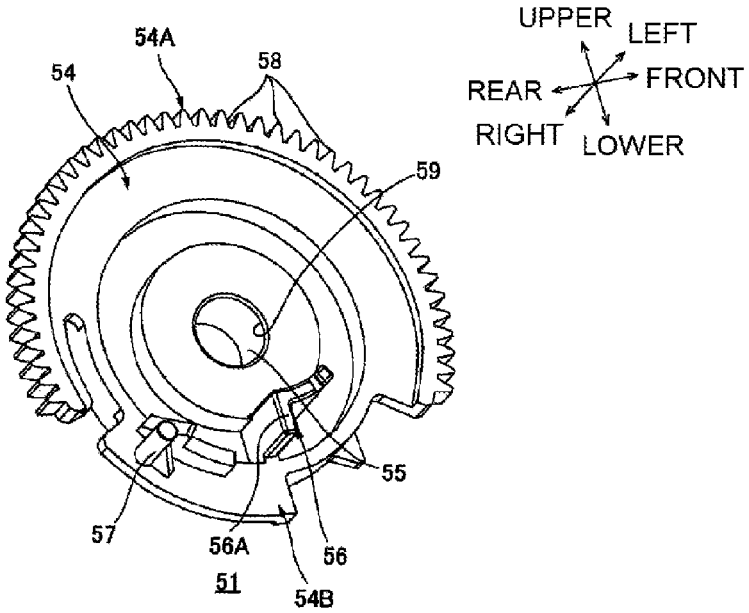
FIG. 5A is a perspective view of a toothless gear shown in FIG. 4A, as seen from a left-lower side.
Figure 5B:
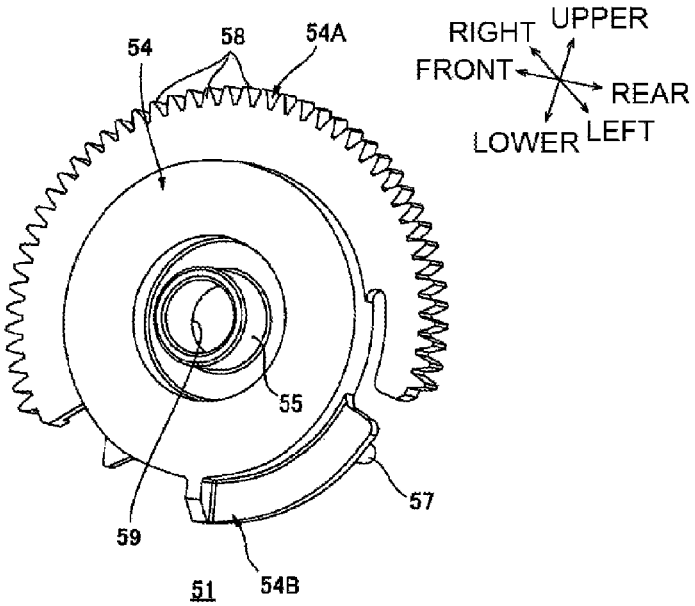
FIG. 5B is a perspective view of the toothless gear shown in FIG. 5A, as seen from a right-lower side.

As shown in FIGS. 5A and 5B, the toothless gear 51 has a gear main body 54, a collar part 55, a slide rib 56 and a boss 57, which is an example of the second abutment part.

The gear main body 54 has a substantially disc shape having a thickness in the left-right direction. An outer diameter of the gear main body 54 is substantially the same as the outer diameter of the gear main body 80 of the idle gear 50. The gear main body 54 has a teeth part 54A, which is an example of the contact part, and a toothless part 54B, which is an example of the non-contact part.

The teeth part 54A is a part having a central angle of about 240° of the gear main body 54, and has a fan-like plate shape, in a side view. The teeth part 54A has gear teeth 58 over a circumference thereof.

The toothless part 54B is a part having a central angle of about 120° of the gear main body 54, except for the teeth part 54A of the gear main body 54. The toothless part 54B has no gear teeth over a circumference thereof.

Also, the gear main body 54 has a fitting hole 59. The fitting hole 59 is arranged at a diametrical center of the gear main body 54. The fitting hole 59 has a substantially circular shape, in a side view, and penetrates the gear main body 54 in the left-right direction. As shown in FIG. 8, an inner diameter of the fitting hole 59 is substantially the same as the outer diameter of the support shaft 36.

As shown in FIG. 5B, the collar part 55 is arranged on the right surface of the gear main body 54. The collar part 55 has a substantially cylindrical shape extending in the left-right direction, and protrudes rightward from a peripheral edge of the fitting hole 59 of the gear main body 54. An inner diameter of the collar part 55 is substantially the same as the inner diameter of the fitting hole 59. An outer diameter of the collar part 55 is substantially the same as the inner diameter of the gear collar 81, as shown in FIG. 8. That is, a thickness of the collar part 55 is substantially the same as a value obtained by subtracting an outer radius of the support shaft 36 from an inner radius of the gear collar 81.

As shown in FIG. 5A, the slide rib 56 is arranged at a substantially center of the toothless part 54B in the circumferential direction and at a substantially center of the toothless part 54B in the diametrical direction on the left surface of the toothless part 54B. The slide rib 56 has a substantially plate shape extending in the diametrical direction of the gear main body 54, and protrudes leftward from the left surface of the toothless part 54B.

The boss 57 is arranged upstream from the slide rib 56 in the counterclockwise direction at an interval therebetween, as seen from the left side, on the left surface of the toothless part 54B. The boss 57 has a substantially cylindrical shape extending in the left-right direction, and protrudes leftward from an outer part of the left surface of the toothless part 54B in the diametrical direction.

As shown in FIG. 8, the collar part 55 is inserted between the support shaft 36 and the gear collar 81 and the collar part 55 and the fitting hole 59 accommodate therein the support shaft 36, so that the toothless gear 51 is rotatably supported to the support shaft 36.

Thereby, the toothless gear 51 is arranged to overlap with the idle gear 50 in the left-right direction. Also, the support shaft 36 rotatably supports both the idle gear 50 and the toothless gear 51. For this reason, each of the idle gear 50 and the toothless gear 51 rotates about a central axis A of the support shaft 36, which is a center of rotation. That is, the idle gear 50 and the toothless gear 51 rotates about the same rotational axis A.

In the meantime, although specifically described later, as shown in FIG. 7A, the driving force is transmitted from the second agitator gear 46, so that the toothless gear 51 is irreversibly rotated from an initial position to a terminal position in the rotating direction R, which is the counterclockwise direction, as seen from the left side.

Figure 6A:
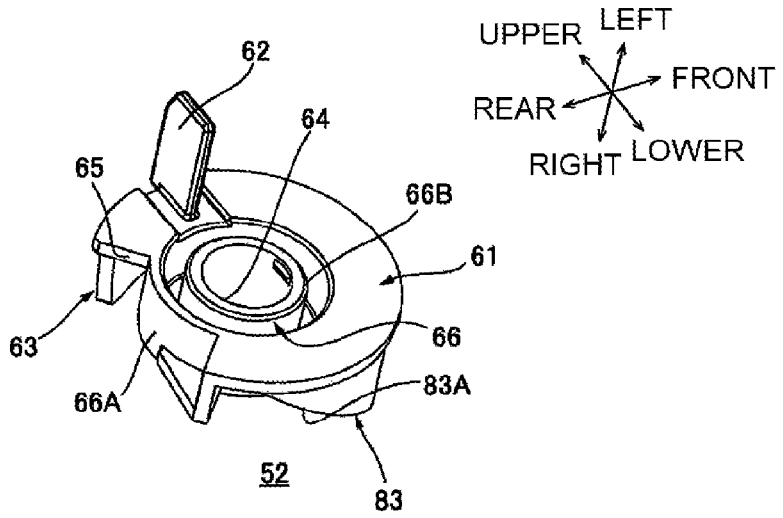
FIG. 6A is a perspective view of a detection member shown in FIG. 4A, as seen from a left-lower side.
Figure 6B:
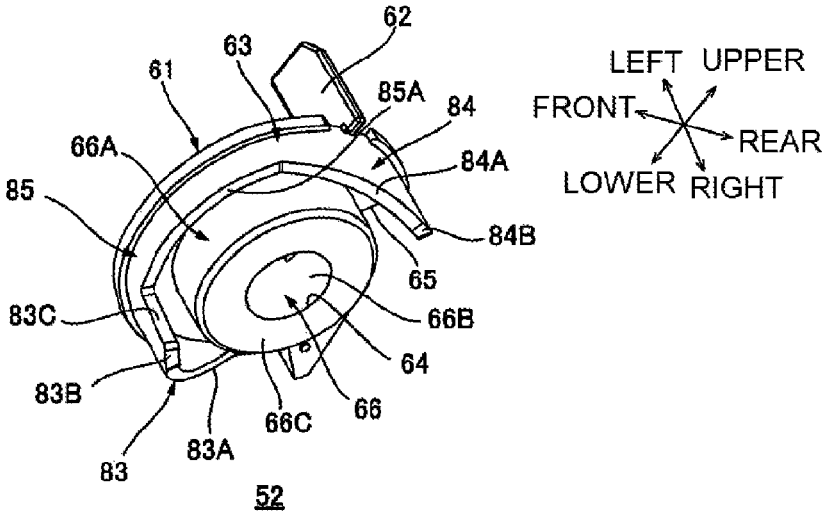
FIG. 6B is a perspective view of the detection member shown in FIG. 6A, as seen from a right-front side.

As shown in FIG. 4A, the detection member 52 is arranged at the left of the toothless gear 51. As shown in FIGS. 6A and 6B, the detection member 52 integrally has a cylindrical part 66, a collar part 61, a detection projection 62, which is an example of the detected part, and a displacement part 63.

The cylindrical part 66 is arranged at a substantially central portion of the detection member 52 in the diametrical direction. The cylindrical part 66 has an outer cylinder 66A and an inner cylinder 66B.

As shown in FIG. 6B, the outer cylinder 66A has a substantially cylindrical shape extending in the left-right direction and a right end portion thereof is closed. The outer cylinder 66A has a through-hole 64.

The through-hole 64 is arranged at a central portion of a right wall 66C of the outer cylinder 66A in the diametrical direction. The through-hole 64 has a substantially circular shape, in a side view, and penetrates the right wall 66C of the outer cylinder 66A in the left-right direction. A center of the through-hole 64 coincides with a central axis of the outer cylinder 66A. An inner diameter of the through-hole 64 is substantially the same as the outer diameter of the support shaft 36.

As shown in FIG. 6A, the inner cylinder 66B is arranged in the outer cylinder 66A. The inner cylinder 66B has a substantially cylindrical shape extending in the left-right direction and protrudes leftward from a peripheral edge of the through-hole 64 on the right wall 66C of the outer cylinder 66A. An inner diameter of the inner cylinder 66B is the same as the inner diameter of the through-hole 64. A central axis of the inner cylinder 66B coincides with the central axis of the outer cylinder 66A. A size of the inner cylinder 66B in the left-right direction is substantially the same as a size of the outer cylinder 66A in the left-right direction.

The collar part 61 has a substantially circular ring-like plate shape, in a side view, and is enlarged outward, in the diametrical direction, from a left end portion of the outer cylinder 66A. The collar part 61 has a notched portion 65.

As shown in FIG. 7A, the notched portion 65 is arranged at a rear side of the collar part 61, and is arranged at a part overlapping with a front end portion of the first gear part 46A of the second agitator gear 46, as seen from the left-right direction. The notched portion 66 is recessed forward from a rear end edge of the collar part 61 and extends in a circumferential direction of the collar part 61. That is, the collar part 61 is notched at a part overlapping with the first gear part 46A, as seen from the left-right direction.

As shown in FIG. 6A, the detection projection 62 is arranged at an upper end portion of a left surface of the collar part 61. The detection projection 62 has a substantially rectangular plate shape, as seen from the front, and extends leftward from the left surface of the collar part 61. The detection projection 62 extends along the diametrical direction of the collar part 61.

As shown in FIG. 6B, the displacement part 63 is arranged at a peripheral edge part of the collar part 61. The displacement part 63 has a substantially C-shaped plate shape protruding rightward from the right surface of the peripheral edge part of the collar part 61 and extending in the circumferential direction of the collar part 61, in a side view. The displacement part 63 has a first displacement part 83, a connection part 85 and a second displacement part 84.

The first displacement part 83 is arranged at an upstream end portion of the displacement part 63 in the counterclockwise direction, as seen from the left side. The first displacement part 83 has a first inclined surface 83A, which is an example of the inclined surface, a first parallel surface 83B, and a second inclined surface 83C.

As shown in FIG. 7B, the first inclined surface 83A is an upstream end portion of a right surface of the first displacement part 83 in the counterclockwise direction, as seen from the left side. The first inclined surface 83A continues to the right surface of the collar part 61 and is inclined rightward towards the downstream side in the counterclockwise direction, as seen from the left side.

As shown in FIG. 6B, the first parallel surface 83B continues from the first inclined surface 83A and extends downstream in the counterclockwise direction, as seen from the left side. The first parallel surface 83B is parallel with the right surface of the collar part 61 so that a distance thereof from the right surface of the collar part 61 in the left-right direction is constant.

The second inclined surface 83C is a downstream end portion of the right surface of the first displacement part 83 in the counterclockwise direction, as seen from the left side. The second inclined surface 83C continues from the first parallel surface 83B and extends so that it is inclined leftward towards the downstream side in the counterclockwise direction, as seen from the left side.

The connection part 85 is arranged to continue to a downstream side of the first displacement part 83 in the counterclockwise direction, as seen from the left side. The connection part 85 is arranged between the first displacement part 83 and the second displacement part 84 in the circumferential direction of the collar part 61 and connects the same. The connection part 85 has a continuous surface 85A.

The continuous surface 85A is a right surface of the connection part 85, and extends downstream in the counterclockwise direction continuously from a left end portion of the second inclined surface 83C of the first displacement part 83, as seen from the left side. The continuous surface 85A is parallel with the right surface of the collar part 61 so that a distance thereof from the right surface of the collar part 61 in the left-right direction is constant.

The second displacement part 84 is arranged at a downstream end portion of the displacement part 63 in the counterclockwise direction, as seen from the left side, and is arranged to continue to a downstream side of the connection part 85 in the counterclockwise direction, as seen from the left side. The second displacement part 84 has a third inclined surface 84A, which is an example of the inclined surface, a second parallel surface 84B, and a fourth inclined surface 84C.

The third inclined surface 84A continues from a downstream end portion of the continuous surface 85A in the counterclockwise direction, as seen from the left side, and is inclined rightward towards the downstream side in the counterclockwise direction, as seen from the left side.

The second parallel surface 84B continues from the third inclined surface 84A and extends downstream in the counterclockwise direction, as seen from the left side. The second parallel surface 84B is parallel with the right surface of the collar part 61 so that a distance thereof from the right surface of the collar part 61 in the left-right direction is constant.

Figure 11A:
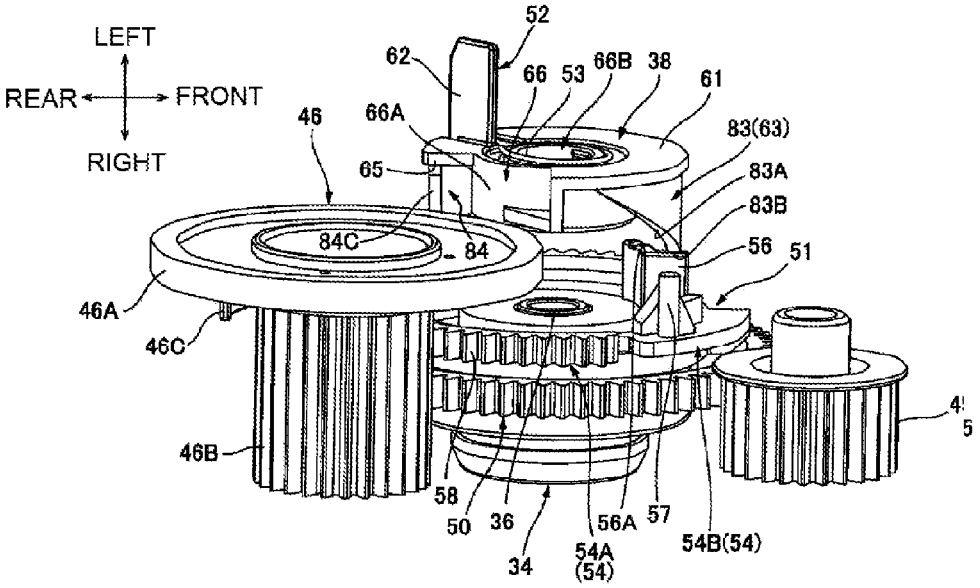
FIG. 11A is a perspective view of the detection unit, the toothless gear, the first agitator gear and the second agitator gear shown in FIG. 9C, as seen from a left-lower side.

As shown in FIG. 11A, the fourth inclined surface 84C is a downstream end portion of the right surface of the second displacement part 84 in the counterclockwise direction, as seen from the left side. The fourth inclined surface 84C continues from the second parallel surface 84B and is inclined leftward towards the downstream side in the counterclockwise direction, as seen from the left side. Also, a downstream end portion of the fourth inclined surface 84C in the counterclockwise direction, as seen from the left side, continues to the right surface of the collar part 61.

As shown in FIG. 8, the detection member 52 is arranged so that the through-hole 64 communicates with an internal space of the support shaft 36 in the left-right direction and the first inclined surface 83A, the first parallel surface 83B, the second inclined surface 83C, the continuous surface 85A, the third inclined surface 84A, the second parallel surface 84B and the fourth inclined surface 84C face the gear main body 54 in the left-right direction. That is, as shown in FIGS. 7A and 7B, the first inclined surface 83A and the third inclined surface 84A are inclined to be closer to the gear main body 54 as they face downstream in the rotating direction R.

As shown in FIG. 4A, the compression spring 53 is arranged at the left of the detection member 52. The compression spring 53 has an air-core coil shape extending in the left-right direction. As shown in FIG. 8, an inner diameter of the compression spring 53 is substantially the same as the outer diameter of the inner cylinder 66B. The inner cylinder 66B is inserted to a right end portion of the compression spring 53, so that the compression spring 53 is supported to the detection member 52.

(ii-3) Gear Cover

As shown in FIGS. 1, 3A and 4A, the gear cover 39 covers the gear train 37 and the detection unit 38. The gear cover 39 has a substantially box shape opening rightward. As shown in FIGS. 1 and 3A, the gear cover 39 integrally has a cover plate 67, a detection member accommodation part 69, and a peripheral sidewall 68.

The cover plate 67 is arranged at the left of the gear train 37 and the detection unit 38, and covers the gear train 37 and the detection unit 38 from left. The cover plate 67 has a substantially rectangular plate shape extending in the front-rear direction, in a side view. The cover plate 67 has a coupling exposing hole 70, and a detection member passing hole 71, as shown in FIGS. 1 and 8.

The coupling exposing hole 70 is arranged at a rear end portion of the cover plate 67. The coupling exposing hole 70 has a substantially circular shape, in a side view, and penetrates the cover plate 67 in the left-right direction. An inner diameter of the coupling exposing hole 70 is substantially the same as an outer diameter of the coupling part 48.

The detection member passing hole 71 is arranged at a front end portion of the cover plate 67, as shown in FIGS. 3A and 8. The detection member passing hole 71 has a substantially circular shape, in a side view, and penetrates the cover plate 67 in the left-right direction. An inner diameter of the detection member passing hole 71 is greater than the outer diameter of the collar part 61.

As shown in FIGS. 1 and 3A, the detection member accommodation part 69 protrudes leftward from the front end portion of the cover plate 67. As shown in FIG. 8, the detection member accommodation part 69 has a circumferential wall 72, a closing wall 73, and a guide shaft 74.

The circumferential wall 72 has a substantially cylindrical shape extending in the left-right direction, and protrudes leftward from a peripheral edge of the detection member passing hole 71 of the cover plate 67.

As shown in FIGS. 1 and 3A, the closing wall 73 closes a left end surface of the circumferential wall 72, and has a substantially circular plate shape, in a side view. The closing wall 73 has a slit 75.

The slit 75 is arranged at a rear-upper side of the closing wall 73. The slit 75 extends in a diametrical direction of the closing wall 73, and penetrates the closing wall 73 in the left-right direction. The slit 75 has a size permitting the detection projection 62 to pass therethrough.

As shown in FIG. 8, the guide shaft 74 is arranged on a right surface of the closing wall 73. The guide shaft 74 has a substantially cylindrical shape extending in the left-right direction, and extends rightward from a diametrical center of the closing wall 73. The guide shaft 74 has a base end portion 74A and a tip portion 74B.

The base end portion 74A is a left part of the guide shaft 74 and has a substantially cylindrical shape extending in the left-right direction. An outer diameter of the base end portion 74A is substantially the same as the inner diameter of the inner cylinder 60B, and is also substantially the same as the outer diameter of the support shaft 36.

The tip portion 74B is a right part of the guide shaft 74. The tip portion 74B has a truncated conical shape tapering rightward and protrudes rightward from a right end portion of the base end portion 74A. A central axis of the tip portion 74B coincides with a central axis of the base end portion 74A. A radius of a left end portion (lower base) of the tip portion 74B is smaller than an outer diameter of the base end portion 74A.

The peripheral sidewall 68 protrudes rightward from the peripheral end edge of the cover plate 67.

The gear cover 39 is mounted to the left sidewall 30 so that the tip portion 74B of the guide shaft 74 is inserted into the support shaft 36 and the base end portion 74A of the guide shaft 74 is inserted into the compression spring 53 and the inner cylinder 60B.

Thereby, the detection member 52 is supported to the guide shaft 74 of the gear cover 39 so that it can move in the left-right direction.

Also, the compression spring 53 is interposed between the right wall 66C of the outer cylinder 66A of the detection member 52 and the closing wall 73 of the gear cover 39. Thereby, a right end portion of the compression spring 53 contacts the left surface of the right wall of the outer cylinder 60A, and a left end portion of the compression spring 53 contacts the right surface of the closing wall 73. For this reason, the compression spring 53 always urges rightward the detection member 52.

Also, as shown in FIG. 1, the coupling part 48 of the developing coupling 41 is fitted in the coupling exposing hole 70.

(ii-4) Initial State of Detection Unit

Hereinafter, a state of the detection unit 38 of the new product developing cartridge 1, i.e., before the developing cartridge 1 is first used is described.

As shown in FIG. 7A, the toothless gear 51 of the new product developing cartridge 1 is located at an initial position, which is an example of the first position.

At the initial position of the toothless gear 51, the downstream end portion of the teeth part 54A in the rotating direction R is arranged at an interval from a front-upper side of the second gear part 46B of the second agitator gear 46, and the toothless part 54B faces the second gear part 46B at an interval therebetween in the diametrical direction of the gear main body 54.

At this time, the boss 57 is arranged at a rightward interval from the front part of the first gear part 46A, and is also arranged at a forward interval from the second gear part 46B.

Also, as shown in FIG. 7B, the slide rib 56 is arranged at the rear of the first displacement part 83 of the detection member 52.

A free end portion 56A of the slide rib 56 contacts the right surface of the collar part 61 at the rear of the first inclined surface 83A. For this reason, the detection member 52 is located at a retreat position at which it is located at the most relatively rightward position, by the urging force of the compression spring 53.

At this time, as shown in FIG. 8, the detection projection 62 of the detection member 52 is accommodated in the detection member accommodation part 69 so that it coincides with the slit 75, as seen from left. That is, a left end surface of the detection projection 62 is positioned at the right of the left surface of the closing wall 73.

Also, the left end portion of the detection projection 62 is arranged in the slit 75. Thereby, the detection member 52 is restrained from rotating relatively to the guide shaft 74.

4. Details of Apparatus Main Body

As shown in FIGS. 1 and 8, the apparatus main body 12 has a main body coupling 100, and a detection mechanism 101.

As shown in FIG. 1, the main body coupling 100 is arranged at a leftward interval from the coupling part 48 of the developing coupling 41 with the developing cartridge 1 being mounted to the apparatus main body 12. Also, the main body coupling 100 has a substantially cylindrical shape extending in the left-right direction and is configured so that a right end portion thereof can be inserted into the internal space 48B of the coupling part 48.

The main body coupling 100 has a pair of engaging projections 100A. Each of the pair of engaging projections 100A has a substantially cylindrical shape extending in the outer side of the main body coupling 100 in the diametrical direction. The pair of engaging projections 100A is arranged at an interval of 180° in a circumferential direction on a circumferential surface of a right end portion of the main body coupling 100.

The main body coupling 100 is configured to move in the left-right direction in accordance with the opening/closing operation of the front cover 17 by a well-known interlocking mechanism. Also, the main body coupling 100 is configured so that a driving force from a driving source such as a motor (not shown) provided to the apparatus main body 12 is transmitted thereto. When the driving force is transmitted, the main body coupling 100 is rotated in the clockwise direction, as seen from the left side.

As shown in FIG. 8, the detection mechanism 101 has an optical sensor 91, an actuator 92, and a control unit 93.

The optical sensor 91 is arranged at a left-upper side of the detection member accommodation part 69 with the developing cartridge 1 being mounted to the apparatus main body 12. The optical sensor 91 has a light emitting device and a light receiving device facing each other at an interval in the front-rear direction. The light emitting device always emits detection light towards the light receiving device. The light receiving device receives the detection light emitted from the light emitting device. The optical sensor 91 generates a light receiving signal when the light receiving device receives the detection light, and does not generate a light receiving signal when the light receiving device does not receive the detection light. The optical sensor 91 is electrically connected to the control unit 93.

The actuator 92 is arranged at the right of the optical sensor 91. The actuator 92 has a substantially rod shape connecting a left-upper side and a right-lower side. The actuator 92 has a shaft 97, an abutting part 95 and a light shielding part 96.

The shaft 97 has a substantially cylindrical shape extending in the front-rear direction and is arranged at a substantially center of the actuator 92 in the upper-lower direction. The shaft 97 is rotatably supported in the apparatus main body 12, so that the actuator 92 can be rotated to a non-detection position at which the detection light of the optical sensor 91 is shielded, as shown in FIG. 8B, and to a detection position at which the detection light of the optical sensor 91 is not shielded, as shown in FIG. 11B, about the shaft 97 serving as a support point.

As shown in FIG. 8, the abutting part 95 is arranged at a right lower end portion of the actuator 92. The abutting part 95 has a substantially plate shape extending in the front-rear and upper-lower directions. The abutting part 95 is arranged at a leftward interval from the slit 75 of the detection member accommodation part 69 with the developing cartridge 1 being mounted to the apparatus main body 12.

The light shielding part 96 is arranged at a left upper end portion of the actuator 92. The light shielding part 96 has a substantially plate shape extending in the upper-lower and left-right directions.

Figure 11B:
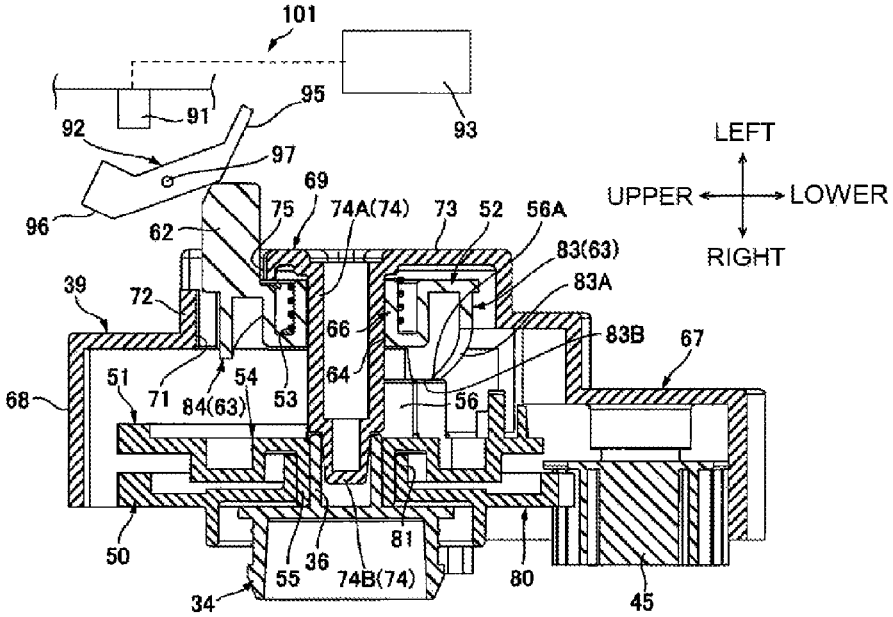
FIG. 11B is a sectional view corresponding to the A-A section of FIG. 7A, illustrating the state shown in FIG. 11A.

The light shielding part 96 is positioned between the light emitting device and light receiving device of the optical sensor 91 when the actuator 92 is located at the non-detection position, and is retreated rightward from between the light emitting device and light receiving device of the optical sensor 91 when the actuator 92 is located at the detection position (FIG. 11B). In the meantime, the actuator 92 is always urged towards the non-detection position by an urging member (not shown).

The control unit 93 has a circuit board having an application specific integrated circuit (ASIC) and is arranged in the apparatus main body 12. Also, the control unit 93 is configured to count the number of rotations of the developing roller 2.

5. Detection Operation

When the developing cartridge 1 is mounted to the apparatus main body 12 and the front cover 17 is closed, the right end portion of the main body coupling 100 is inserted into the space 48B of the coupling part 48 of the developing coupling 41, in accordance with the closing operation of the front cover 17, as shown in FIG. 1. At this time, each of the pair of engaging projections 100A faces each of the pair of protrusions 48A of the coupling part 48 in the circumferential direction of the coupling part 48.

After that, the control unit 93 starts a warm-up operation of the printer 11.

Then, the driving force from the driving source such as a motor (not shown) is transmitted, so that the main body coupling 100 is rotated in the clockwise direction, as seen from the left side. Thereby, the engaging projections 100A are respectively engaged with the corresponding protrusions 48A.

Then, the driving force is input from the apparatus main body 12 to the developing coupling 41 through the main body coupling 100, and the developing coupling 41 is rotated in the clockwise direction, as seen from the left side, as shown in FIG. 3B.

Thereby, the developing gear 42, the supply gear 43 and the connection gear 44 are rotated in the counterclockwise direction, as seen from the left side. Then, the developing roller 2 and the supply roller 3 are rotated in the counterclockwise direction, as seen from the left side, as shown in FIG. 2. Also, when the connection gear 44 is rotated, the second agitator gear 46 is rotated in the clockwise direction, as seen from the left side, as shown in FIG. 3B.

Figure 9A:
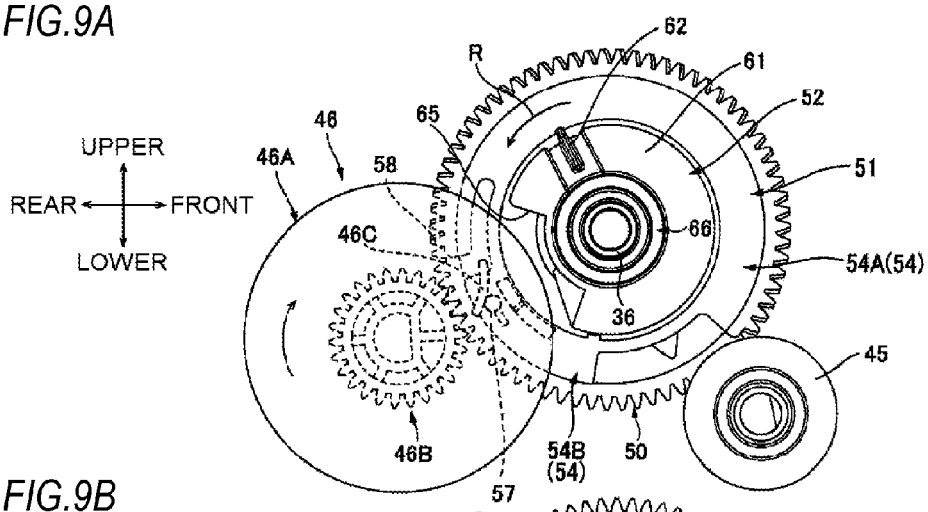
FIG. 9A illustrates a detection operation of the developing cartridge, illustrating a state where an abutment rib of the second agitator gear abuts on a boss of the toothless gear.

When the agitator gear 46 is rotated, the abutment rib 46C abuts on the boss 57 of the toothless gear 51 located at the initial position, in accordance with the rotation of the second agitator gear 46, as shown in FIG. 9A, thereby pressing the boss 57 in a front-lower direction. Thereby, the toothless gear 51 is rotated from the initial position in the rotating direction R.

Figure 9B:
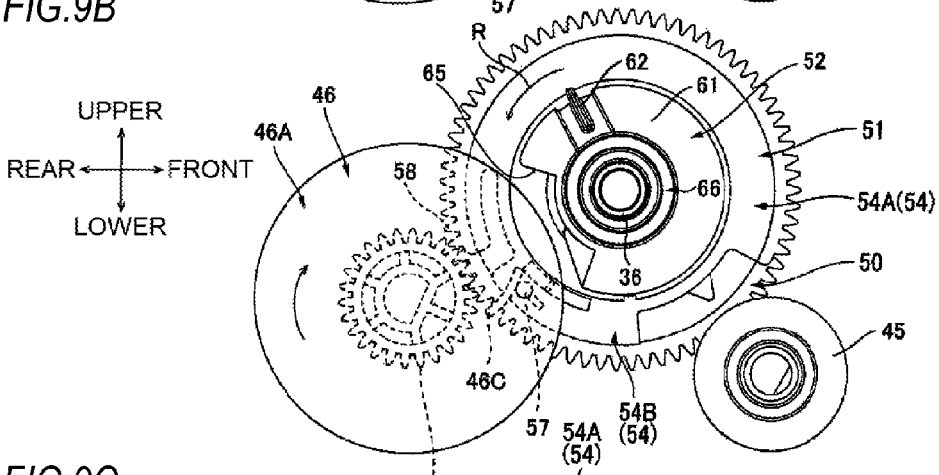
FIG. 9B illustrates the detection operation of the developing cartridge subsequent to FIG. 9A, illustrating a state where the toothless gear is located at a driving transmitting position.

Thereby, as shown in FIG. 9B, the toothless gear 51 reaches a driving transmitting position, which is an example of the second position, and is engaged with the front upper end portion of the second gear part 46B of the second agitator gear 46 at the gear teeth 58 of the downstream end portion of the teeth part 54A in the rotating direction R. That is, the teeth part 54A and the second gear part 46B contacts with each other.

Figure 9C:
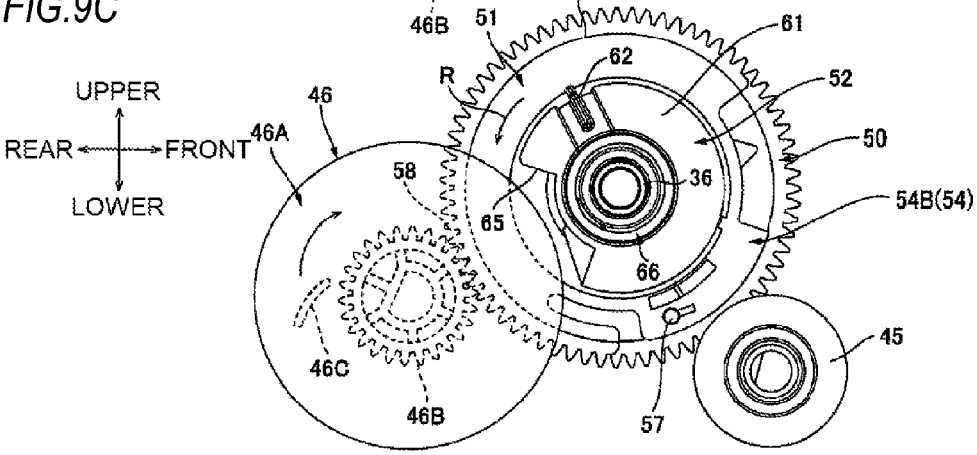
FIG. 9C illustrates the detection operation of the developing cartridge subsequent to FIG. 9B, illustrating an engaged state between the toothless gear and the second agitator gear at a state where the detection member is located at an advance position.

Then, when the second agitator gear 46 is rotated, the driving force is transmitted from the second agitator gear 46 to the toothless gear 51, so that the toothless gear 51 is further rotated in the rotating direction R, as shown in FIG. 9C. Thereby, the slide rib 56 of the toothless gear 51 is moved in the rotating direction R, in accordance with the rotation of the toothless gear 51, as shown in FIG. 7B.

At this time, the free end portion 56A of the slide rib 56 presses leftward the first inclined surface 83A of the first displacement part 83 while sliding along the first inclined surface 83A in the rotating direction R. Thereby, the detection member 52 is gradually moved leftward from the retreat position against the urging force of the compression spring 63. That is, the toothless gear 51 is rotated, so that the detection member 52 is applied with the driving force from the toothless gear 51 and is thus moved leftward, and the detection projection 62 is moved leftward in accordance with the movement of the detection member 52.

Then, as shown in FIG. 11A, as the toothless gear 51 is rotated, the free end portion 56A of the slide rib 56 separates from the first inclined surface 83A and abuts on the first parallel surface 83B.

At this time, as shown in FIG. 11B, the detection member 52 is arranged at an advance position at which it is advanced most leftward, against the urging force of the compression spring 53.

At the state where the detection member 52 is located at the advance position, the detection projection 62 is advanced more leftward than the closing wall 73 of the detection member accommodation part 69 through the slit 75. Then, the detection projection 62 abuts on the abutting part 95 of the actuator 92 from right, and presses leftward the abutting part 95. Thereby, the actuator 92 swings from the non-detection position in the counterclockwise direction, as seen from the back, and is thus located at the detection position.

At this time, the light shielding part 96 is retreated toward the right-upper side from between the light emitting device and the light receiving device of the optical sensor 91. Thereby, the light receiving device of the optical sensor 91 receives the detection light, and the optical sensor 91 outputs a light receiving signal.

Then, the control unit 93 determines that the new product developing cartridge 1 has been mounted to the apparatus main body 12, because the light receiving signal is received from the optical sensor 91 within predetermined time after the warm-up operation starts. Thereby, the control unit 93 resets the counted number of rotations of the developing roller 2.

Then, when the toothless gear 51 is further rotated, the free end portion 56A of the slide rib 56 separates from the first parallel surface 83B, abuts on the second inclined surface 83C, and slides along the second inclined surface 83C in the rotating direction R. Thereby, the detection member 52 is gradually moved rightward by the urging force of the compression spring 63.

Thereby, the detection projection 62 is gradually retreated into the detection member accommodation part 69. Then, the actuator 92 swings from the detection position in the clockwise direction by an urging member (not shown), as seen from the back.

Then, when the toothless gear 51 is further rotated, the free end portion 56A of the slide rib 56 separates from the second inclined surface 83C, and abuts on the continuous surface 85A. Thereby, the detection member 52 is retreated rightward by the urging force of the compression spring 53, and the detection projection 62 is spaced rightward from the abutting part 95 of the actuator 92. For this reason, the actuator 92 is returned to the non-detection position by the urging member (not shown).

Thereby, the light shielding part 96 of the actuator 92 is located between the light emitting device and the light receiving device of the optical sensor 91. Thus, the light receiving device of the optical sensor 91 does not receive the detection light and the optical sensor 91 stops the output of the light receiving signal.

Then, when the toothless gear 51 is further rotated, the slide rib 56 abuts on the second displacement part 84. Like the first displacement part 83, the free end portion 56A of the slide rib 56 sequentially slides along the third inclined surface 84A and second parallel surface 84B of the second displacement part 84, thereby pressing leftward the detection member 52.

Then, as shown in FIG. 11B, the detection member 52 is again located at the advance position, and the detection projection 62 abuts on the abutment part 95 of the actuator 92. Thus, the actuator 92 swings from the non-detection position to the detection position. Thereby, the light receiving device of the optical sensor 91 again receives the detection light and the optical sensor 91 outputs a light receiving signal.

Figure 10A:
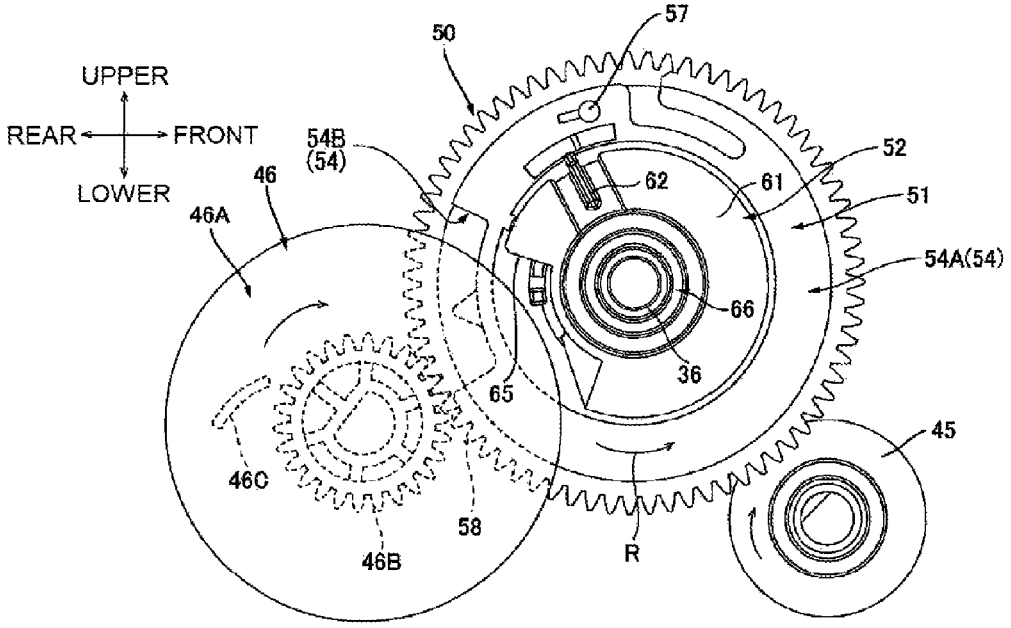
FIG. 10A illustrates the new product detection operation of the developing cartridge subsequent to FIG. 9C, illustrating a state where a teeth part of the toothless gear is spaced from the agitator gear.

Then, when the toothless gear 51 is further rotated, the gear teeth 58 of the upstream end portion of the teeth part 54A of the toothless gear 51 in the rotating direction R are spaced from the second gear part 46B of the second agitator gear 46, as shown in FIG. 10A.

Figure 12A:
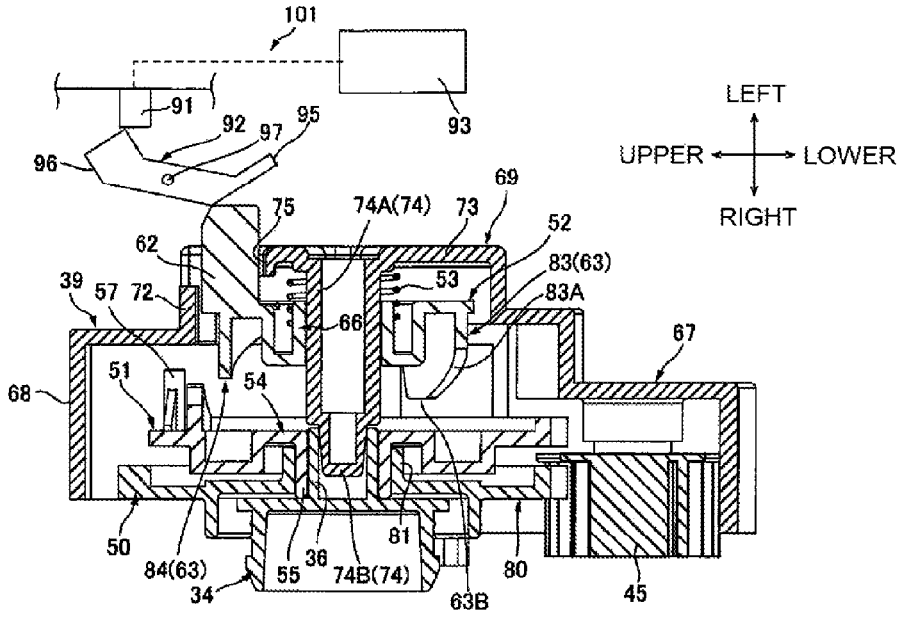
FIG. 12A is a sectional view corresponding to the A-A section of FIG. 7A, illustrating the state shown in FIG. 10A.

At this time, the free end portion 56A of the slide rib 56 separates from the second parallel surface 84B and abuts on the fourth inclined surface 84C. Thus, the detection member 52 is gradually moved rightward by the urging force of the compression spring 63, as shown in FIG. 12A.

Figure 10B:
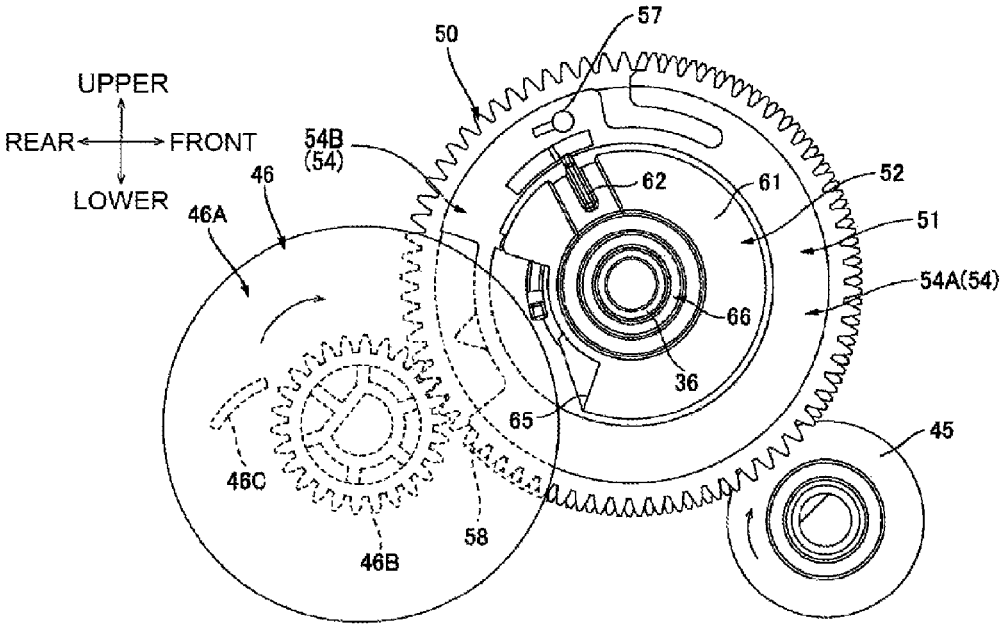
FIG. 10B illustrates the new product detection operation of the developing cartridge subsequent to FIG. 10A, illustrating a state where the toothless gear is located at a terminal position.

Also, as shown in FIG. 10B, when the detection member 52 is gradually moved leftward, the free end portion 56A of the slide rib 56 is pressed in the rotating direction R by the fourth inclined surface 84C, so that the toothless gear 51 is further rotated in the rotating direction R.

The toothless gear 51 is stopped at a state where the teeth part 54A of the toothless gear 51 is spaced from the second gear part 46B of the second agitator gear 46. Thereby, the toothless gear 51 is positioned at a terminal position upon the completion of the rotating operation.

At this time, the slide rib 56 is close to the fourth inclined surface 84C of the second displacement part 84 at a downstream side in the rotating direction R. Thereby, the toothless gear 51 is restrained from rotating towards an upstream side in the rotating direction R. For this reason, the toothless gear 51 is maintained at the terminal position and keeps stopping, irrespective of the rotation of the second agitator gear 46. That is, the toothless gear 51 is irreversibly rotated in order of the initial position, the driving transmitting position and the terminal position.

Figure 12B:
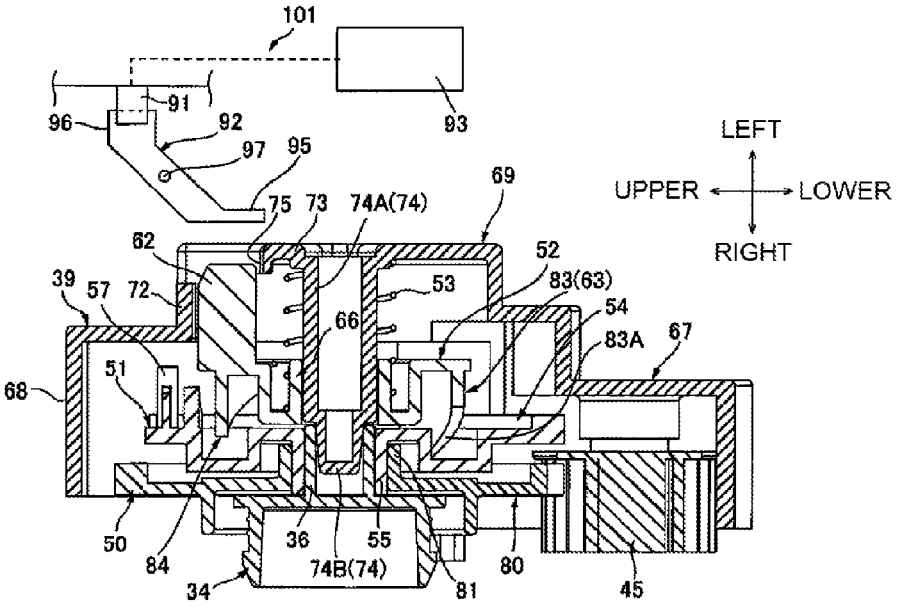
FIG. 12B is a sectional view corresponding to the A-A section of FIG. 7A, illustrating the state shown in FIG. 10B.

Also, the free end portion 56A of the slide rib 56 abuts on the right surface of the collar part 61 at a more downstream side than the second displacement part 84 in the rotating direction R. For this reason, the detection member 52 is again located at the retreat position, as shown in FIG. 12B.

Thereby, the abutting state between the abutting part 95 of the actuator 92 and the detection projection 62 is released, so that the actuator 92 is returned from the detection position to the non-detection position and the optical sensor 91 stops the output of the light receiving signal.

Thereafter, when the predetermined time elapses, the control unit 93 ends the warm-up operation.

Here, the number of receiving times of the light receiving signal, which is received from the optical sensor 91 by the control unit 93 within predetermined time after the warm-up operation starts, is associated with the specification (specifically, the maximum number of image formation sheets) of the developing cartridge 1. For example, when the light receiving signal is received two times, the control unit 93 determines that the developing cartridge 1 of a first specification (maximum number of image formation sheets: 6,000 sheets) has been mounted to the apparatus main body 12.

On the other hand, when the light receiving signal is not received from the optical sensor 91 within the predetermined time after the warm-up operation starts, the control unit 93 determines that the developing cartridge 1 used or being used has been mounted to the apparatus main body 12.

6. Driving Operations

In the above detection operation, the second agitator gear 46 transmits the driving force from the developing coupling 41 to the toothless gear 51 and to the idle gear 50, as shown in FIG. 7A. Also, in the image forming operation, even after the toothless gear 51 is stopped, the second agitator gear 46 transmits the driving force from the developing coupling 41 to the idle gear 50.

Specifically, when the second agitator gear 46 is rotated in the clockwise direction, as seen from the left side, the idle gear 50 is rotated in the counterclockwise direction, as seen from the left side. Then, the driving force is transmitted to the first agitator gear 45 from the idle gear 50, so that the first agitator gear 45 is rotated in the clockwise direction, as seen from the left side. That is, the idle gear 50 rotates by the driving force transmitted from the developing coupling 41 through the connection gear 44 and the second agitator gear 46 and transmits the driving force to the first agitator gear 45. That is, the idle gear 50 is arranged between the second agitator gear 46 and the first agitator gear 45 in a driving force transmitting direction from the developing coupling 41 towards the first agitator gear 45.

When the first agitator gear 45 and the second agitator gear 46 are rotated, respectively, the driving force is transmitted to the first agitator 6 and the second agitator 7, respectively. Thereby, as shown in FIG. 2, each of the first agitator 6 and the second agitator 7 is rotated in the clockwise direction, as seen from the left side.

Here, since the number of the gear teeth provided to the second gear part 46B of the second agitator gear 46 is the same as the number of the gear teeth provided to the first agitator gear 45, the rotating speeds of the first agitator 6 and the second agitator 7 are the same. Also, since the relative positional relation between the first agitator shaft 6A and the stirring blade 6B and the relative positional relation between the second agitator shaft 7A and the stirring blade 7B are the same, the stirring blade 6B of the first agitator 6 and the stirring blade 7B of the second agitator 7 are rotated in the same phase.

7. Operational Effects (i) As shown in FIG. 11B, the detection projection 62 is moved in accordance with the rotation of the toothless gear 51 and is detected by the detection mechanism 101. For this reason, it is possible to enable the apparatus main body 12 to recognize that the unused developing cartridge 1 has been mounted.

Also, as shown in FIG. 8, the idle gear 50 and the toothless gear 51 are arranged to overlap with each other in the left-right direction. For this reason, it is possible to reduce a space for arranging the idle gear 50 and the toothless gear 51 in the front-rear and upper-lower directions.

As a result, it is possible to make the developing cartridge 1 small while enabling the apparatus main body 12 to recognize that the unused developing cartridge 1 has been mounted.

(ii) As shown in FIG. 8, the idle gear 50 and the toothless gear 51 are rotated about the same central axis A. For this reason, it is possible to secure the effective arrangement of the idle gear 50 and the toothless gear 51, thereby reliably making the developing cartridge 1 small.

(iii) As shown in FIG. 8, the developing cartridge 1 has the support shaft 36 rotatably supporting both the idle gear 50 and the toothless gear 51. For this reason, it is possible to arrange the idle gear 50 and the toothless gear 51 so that they reliably overlap with each other in the left-right direction, with a simple configuration.

(iv) As shown in FIG. 2, since the developing cartridge 1 has the first agitator 6, it is possible to stir the toner accommodated in the developing frame 5.

(v) As shown in FIG. 2, since the developing cartridge 1 has the developing roller 2, it is possible to reliably supply the toner to the photosensitive drum 21.

(vi) As shown in FIG. 2, the developing cartridge 1 has the first agitator 6 and the second agitator 7. For this reason, it is possible to more reliably stir the toner accommodated in the developing frame 5.

(vii) As shown in FIG. 7A, the idle gear 50 is arranged between the second agitator gear 46 and the first agitator gear 45 in the driving force transmitting direction. For this reason, the second agitator gear 46 is arranged upstream from the idle gear 50 in the transmitting direction, and the first agitator gear 45 is arranged downstream from the idle gear 50 in the transmitting direction.

As a result, it is possible to sequentially transmit the driving force from the developing coupling 41 to the second agitator gear 46, the idle gear 50 and the first agitator gear 45 while securing the effective arrangement of the idle gear 50, the first agitator gear 45 and the second agitator gear 46. As a result, it is possible to reliably drive the first agitator 6 and the second agitator 7, respectively.

(viii) As shown in FIG. 2, the first agitator 6 and the second agitator 7 are rotated in the same phase. For this reason, it is possible to suppress the interference between the first agitator 6 and the second agitator 7 during the rotations thereof and to effectively stir and convey the toner.

(ix) As shown in FIG. 7A, the idle gear 50 contacts the second gear part 46B of the second agitator gear 46 over the entire circumference thereof. For this reason, the idle gear 50 can always receive the driving force from the second agitator gear 46 upon the rotation of the second agitator gear 46. As a result, it is possible to always transmit the driving force from the developing coupling 41 to the first agitator gear 45 and further to the first agitator 6 through the idle gear 50, so that it is possible to guarantee the reliable driving of the first agitator 6.

In the meantime, the toothless gear 51 has the teeth part 54A and the toothless part 54B, and is moved from the initial position, at which the toothless part 54B faces the second agitator gear 46, to the driving transmitting position, at which the teeth part 54A contacts the second agitator gear 46 and thus receives the driving force from the second agitator gear 46, as shown in FIG. 9C. For this reason, the toothless gear 51 is moved from the initial position, at which the driving force is not transmitted thereto and the rotation thereof is stopped, to the driving transmitting position, at which the teeth part 54A contacts the second agitator gear 46 and thus receives the driving force from the second agitator gear 46, and is thus rotated. As a result, it is possible to rotate the toothless gear 51 and to move the detection projection 62 at a desired timing.

(x) As shown in FIGS. 9A and 9B, during the rotation of the second agitator gear 46, the first abutment rib 46C moves the toothless gear 51 from the initial position to the driving transmitting position by abutting on the boss 57 of the toothless gear 51 located at the initial position. For this reason, it is possible to move the toothless gear 51 from the initial position to the driving transmitting position at a desired timing.

(xi) As shown in FIGS. 3B and 8, the toothless gear 51 is arranged at the opposite side of the developing frame 5 with respect to the idle gear 50, i.e. at the outer side. For this reason, it is possible to suppress the interference between the idle gear 50 and the detection projection 62 which is moved as the toothless gear 51 is rotated.

(xii) As shown in FIGS. 7B and 11A, the detection member 52 moves in the left-right direction by the driving force applied from the toothless gear 51. For this reason, as shown in FIGS. 11A and 11B, when the detection projection 62 is detected by the detection mechanism 101 at the state where the detection member 52 is located at the advance position, it is possible to detect the detection projection 62 at a position distant from the developing frame 5. As a result, it is possible to improve the detection precision.

When the detection member 52 is moved in the rotating direction R of the toothless gear 51, it is necessary to secure a space for the detection projection 62 to move around the rotational axis A of the toothless gear 51. For this reason, there is a limit in making the developing cartridge 1 small in the front-rear and upper-lower directions.

However, since the detection projection 62 moves in the left-right direction, it is not necessary to secure a space for the detection projection 62 to move around the rotational axis A of the toothless gear 51. As a result, it is possible to effectively utilize the space around the rotational axis A of the toothless gear 51, and to make the developing cartridge 1 small in the front-rear and upper-lower directions.

(xiii) As shown in FIG. 7B, the detection member 52 has the displacement part 63 having the first inclined surface 83A, and the toothless gear 51 has the slide rib 56.

As the toothless gear 51 is rotated, the slide rib 56 of the toothless gear 51 gradually presses leftward the first inclined surface 83A of the detection member 52. Thereby, it is possible to smoothly move the detection member 52 in the left-right direction.

(xiv) As shown in FIG. 7A, the detection member 52 has the notched portion 65. For this reason, during the movement of the detection member 52, it is possible to suppress the interference between the detection member 52 and the second agitator gear 46. Also, it is possible to reduce a space for arranging the detection member 52 and the second agitator gear 46, so that it is possible to make the developing cartridge 1 smaller.

(xv) As shown in FIGS. 8 and 11B, the detection member 52 moves in the left-right direction while being restrained from moving in the rotating direction R. For this reason, the detection projection 62 also moves in the left-right direction while being restrained from moving in the rotating direction R.

As a result, it is possible to reduce a space for arranging the detection projection 62 in the rotating direction R. Thereby, it is possible to improve a degree of freedom of the arrangement of the detection projection 62 in the rotating direction R.

8. Modified Embodiments (i) In the above illustrative embodiment, the first agitator 6 has been exemplified as the conveyance member. However, the conveyance member is not limited thereto. For example, the conveyance member may be the developing roller 2, the supply roller 3, an auger or a paddle.

Figure 13:
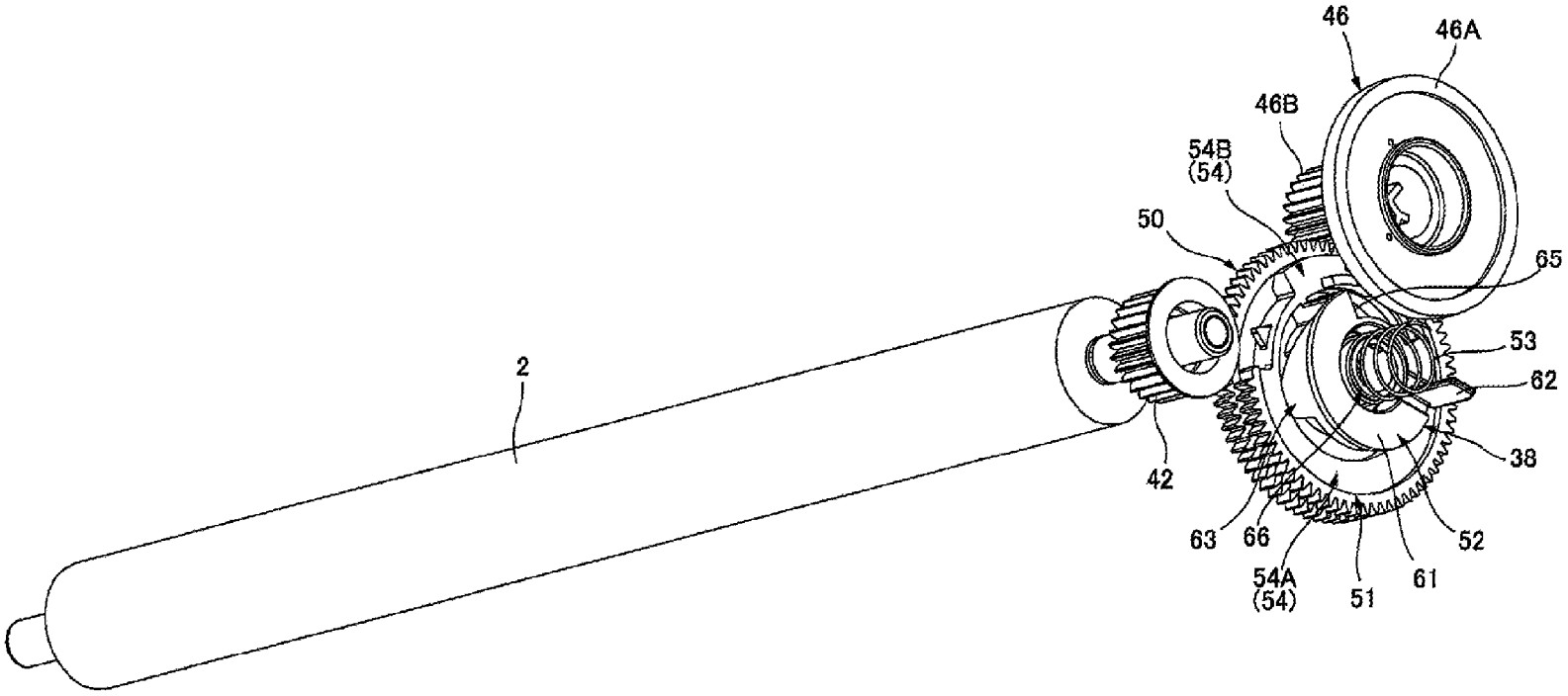
FIG. 13 is a perspective view of the detection unit, the idle gear and a developing roller according to a first modified embodiment of the disclosure.

When the developing roller 2 is an example of the conveyance member, the developing gear 42 is engaged with the idle gear 50, as shown in FIG. 13. For this reason, as the idle gear 50 is rotated, the driving force from the developing coupling 41 is transmitted to the developing roller 2 through the developing gear 42. Thereby, the developing roller 2 is rotated.

(ii) In the above illustrative embodiment, as shown in FIGS. 6A and 6B, the detection member 52 has the first displacement part 83 and the second displacement part 84, and is configured to be arranged at the advance position two times during the detection operation. However, the number of times that the detection member 52 is located at the advance position is not particularly limited.

Figure 14:
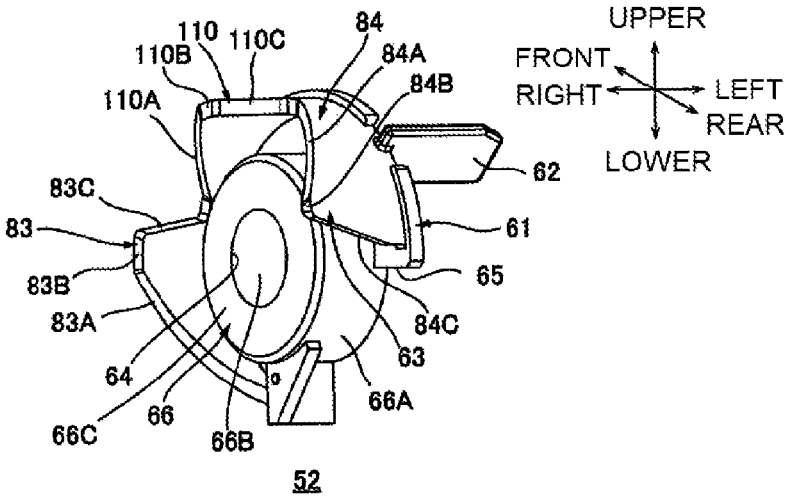
FIG. 14 is a perspective view of the detection member according to a second modified embodiment of the disclosure.

For example, the detection member 52 may be configured to be arranged at the advance position three times during the detection operation. In this case, as shown in FIG. 14, the displacement part 63 of the detection member 52 further has a third displacement part 110 having the same configuration as the first displacement part 83, instead of the connection part 85.

The third displacement part 110 has a fifth inclined surface 110A, which is an example of the inclined surface, a third parallel surface 110B and a sixth inclined surface 110C.

The fifth inclined surface 110A continues from the second inclined surface 83C of the first displacement part 83 and extends so that it is inclined rightward towards the downstream side in the counterclockwise direction, as seen from the left side.

The third parallel surface 110B continues from the fifth inclined surface 110A and extends downstream in the counterclockwise direction, as seen from the left side. The third parallel surface 110B is parallel with the right surface of the collar part 61 so that a distance thereof from the right surface of the collar part 61 in the left-right direction is constant.

The sixth inclined surface 110C continues from the third parallel surface 110B and extends so that it is inclined leftward towards the downstream side in the counterclockwise direction, as seen from the left side. A downstream end portion of the sixth inclined surface 110C in the counterclockwise direction, as seen from the left side, continues to the third inclined surface 84A of the second displacement part 84.

According to the above configuration, during the detection operation, the detection projection 62 of the detection member 52 abuts on the abutting part 95 of the actuator 92 three times, thereby positioning the actuator 92 at the detection position three times. As a result, the control unit 93 receives the light receiving signal from the optical sensor 91 three times.

In this way, when the light receiving signal is received three times, the control unit 93 determines that the developing cartridge 1 of a second specification (maximum number of image formation sheets: 8,000 sheets) has been mounted to the apparatus main body 12.

Also, the detection member 52 may be configured to be arranged at the advance position only one time during the detection operation. In this case, the displacement part 63 has any one of the first displacement part 83, the second displacement part 84 and the third displacement part 110. According to this configuration, during the detection operation, the detection projection 62 of the detection member 52 abuts on the abutting part 95 of the actuator 92 one time, thereby positioning the actuator 92 at the detection position one time. As a result, the control unit 93 receives the light receiving signal from the optical sensor 91 one time. Then, the control unit 93 determines that the developing cartridge 1 of a third specification (maximum number of image formation sheets: 3,000 sheets) has been mounted to the apparatus main body 12.

That is, according to the developing cartridge 1 of the first specification, the displacement part 63 has two projections (the first displacement part 83 and the second displacement part 84) and the maximum number of image formation sheets is 6,000 sheets, as described above. Also, according to the developing cartridge 1 of the second specification, the displacement part 63 has three projections (the first displacement part 83, the second displacement part 84 and the third displacement part 110) and the maximum number of image formation sheets is 8,000 sheets. Also, according to the developing cartridge 1 of the third specification, the displacement part 63 has one projection (any one of the first displacement part 83 and the second displacement part 84 and the third displacement part 110) and the maximum number of image formation sheets is 3,000 sheets.

However, the correspondence relation between the number of the projections provided to the displacement part 63 and the maximum number of image formation sheets of the developing cartridge 1 can be appropriately changed.

Also, the numerical values of the maximum number of image formation sheets of the respective specifications of the developing cartridge 1 (for example, the first specification: 6,000 sheets, the second specification: 8,000 sheet and the third specification: 3,000 sheets) may be appropriately changed to other values (for example, 1,500 sheets, 2,000 sheets, 5,000 sheets and the like).

(iii) In the above illustrative embodiment, the toothless gear 51 has been exemplified as the second rotary member, and the second agitator gear 46 has been exemplified as the fourth rotary member. However, the second rotary member and the fourth rotary member are not limited to the gear. For example, the second rotary member and the fourth rotary member may be configured by friction wheels having no gear teeth.

Figure 15:
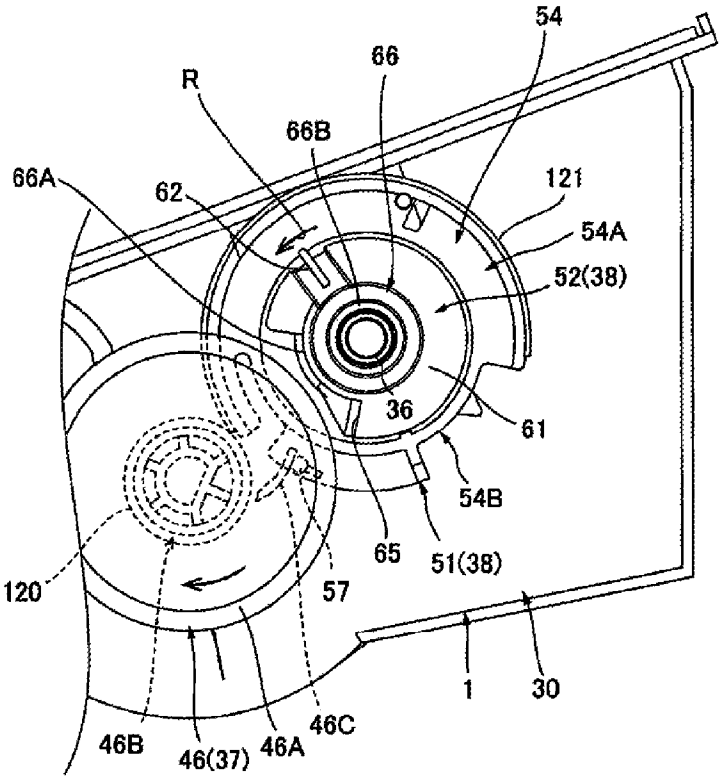
FIG. 15 is a left side view of the second agitator gear and the detection unit according to a third modified embodiment of the disclosure.
Figure 15:
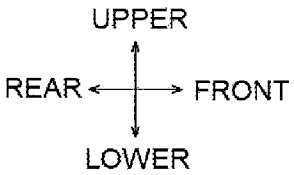

Specifically, as shown in FIG. 15, the second gear part 46B of the second agitator gear 46 may be provided with a first resistance applying member 120 of which at least an outer peripheral surface is configured by a material having a relatively large friction coefficient such as rubber, instead of the gear teeth, the teeth part 54A of the toothless gear 51 may be provided with a second resistance applying member 121 of which at least an outer peripheral surface is configured by a material having a relatively large friction coefficient such as rubber, instead of the gear teeth, and the driving force may be transmitted through friction between the resistance applying members. Meanwhile, in FIG. 15, the idle gear 50 and the first agitator gear 45 are omitted for convenience sake.

Also, in this case, the second gear part 46B of the second agitator gear 46 may be configured to have the gear teeth and only the teeth part 54A of the toothless gear 51 may be provided with the second resistance applying member 121 of which the outer peripheral surface is configured by the material having a relatively large friction coefficient such as rubber.

Figure 16:
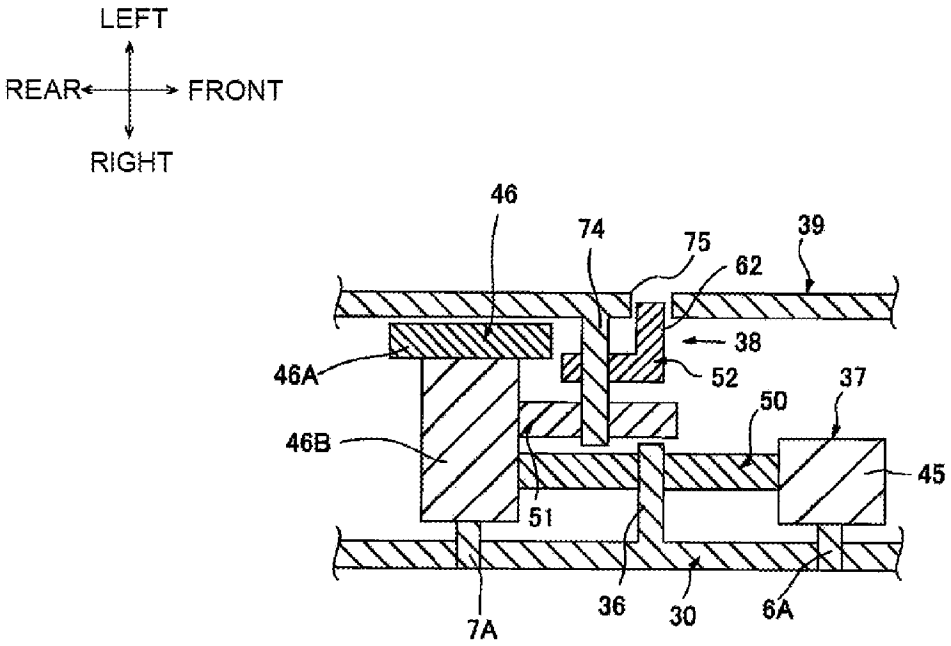
FIG. 16 is a schematic illustration for illustrating an arrangement of the toothless gear and the idle gear according to a fourth modified embodiment of the disclosure.

(iv) In the above illustrative embodiment, the idle gear 50 and the toothless gear 51 are configured to be supported by the support shaft 36 of the toner cap 34 and to rotate about the same rotational axis A, as shown in FIG. 8. However, as shown in FIG. 16, the arrangement of the idle gear 50 and the toothless gear 51 is not particularly limited inasmuch as at least a portion of the idle gear 50 and the toothless gear 51 overlap with each other in the left-right direction.

For example, the support shaft 36 of the toner cap 34 and the guide shaft 74 of the gear cover 39 may be arranged to deviate in the front-rear direction, the idle gear 50 may be rotatably supported to the support shaft 36, and the toothless gear 51 may be rotatably supported to the guide shaft 74. Thereby, the toothless gear 51 is arranged to overlap with the rear part of the idle gear 50 in the left-right direction.

(v) In the above illustrative embodiment, as shown in FIGS. 6A and 6B, the displacement part 63 is provided to the detection member 52. However, the disclosure is not limited thereto. For example, the displacement part 63 may be provided to the toothless gear 51.

In this case, the displacement part 63 is arranged on the left surface of the gear main body 54 of the toothless gear 51, and the detection member 52 has the slide rib 56.

The displacement part 63 is arranged on the left surface of the gear main body 54. On the left surface of the displacement part 63, the first inclined surface 83A, the first parallel surface 83B, the second inclined surface 83C, the continuous surface 85A, the third inclined surface 84A, the second parallel surface 84B and the fourth inclined surface 84C are sequentially arranged in this order from a downstream side towards an upstream side in the rotating direction R.

The first inclined surface 83A is inclined rightward towards the downstream side in the rotating direction R. The first parallel surface 83B continues from the first inclined surface 83A and extends upstream in the rotating direction R. The second inclined surface 83C continues from the first parallel surface 83B and is inclined rightward towards the upstream side in the rotating direction R.

The continuous surface 85A continues from the second inclined surface 83C and extends upstream in the rotating direction R.

The third inclined surface 84A continues from the continuous surface 85A, and is inclined leftward towards the upstream side in the rotating direction R. The second parallel surface 84B continues from the third inclined surface 84A and extends upstream in the rotating direction R. The fourth inclined surface 84C continues from the second parallel surface 84B, and is inclined rightward towards the upstream side in the rotating direction R.

The slide rib 56 is arranged on the right surface of the collar part 61 of the detection member 52. The slide rib 56 protrudes rightward from right surface of the collar part 61. At the initial state of the toothless gear 51, the slide rib 56 is arranged downstream from the first displacement part 83 in the rotating direction R, and the free end portion 56A of the slide rib 56 contacts the left surface of the gear main body 54 at a downstream side of the first inclined surface 83A in the rotating direction R.

In the above detection operation, as the toothless gear 51 is rotated, the first inclined surface 83A of the toothless gear 51 gradually presses leftward the detection member 52. For this reason, it is possible to smoothly move the detection member 52 in the left-right direction.

(vi) In the above illustrative embodiment, the detection projection 62 is advanced and retreated in the left-right direction by the rotation of the toothless gear 51. However, the disclosure is not limited thereto. For example, it is only necessary that the detection projection 62 is moved by the rotation of the toothless gear 51, and need not necessarily be advanced and retreated in the left-right direction.

For example, the detection projection 62 may be configured to move in the circumferential direction of the toothless gear 51, in accordance with the rotation of the toothless gear 51. In this case, the detection projection 62 is arranged on the left surface of the gear main body 54 of the toothless gear 51.

(vii) In the above illustrative embodiment, as shown in FIG. 2, the developing cartridge 1 is configured to be mounted to or demounted from the drum cartridge 20. However, the disclosure is not limited thereto. For example, the developing cartridge 1 may be configured integrally with the drum cartridge 20. In this case, the process cartridge 13 integrally having the developing cartridge 1 and the drum cartridge 20 corresponds to an example of the cartridge.

Also, only the developing cartridge 1 may be configured to be mounted to or demounted from the apparatus main body 12 having the photosensitive drum 21.

Also, the developing cartridge 1 may be configured so that a toner cartridge accommodating therein the toner is mounted to or demounted from the frame having the developing roller 2. In this case, the toner cartridge has the driving unit 32 except for the developing gear 42 and the supply gear 43, the first agitator 6 and the second agitator 7, and corresponds to an example of the cartridge.

Further, only the toner cartridge may be configured to be mounted to or demounted from the apparatus main body 12 having the developing roller 2 and the photosensitive drum 21.

(viii) In the above illustrative embodiment, as shown in FIGS. 6A and 6B, the detection member 52 is made of the well-known plastic and integrally has the detection projection 62. However, the disclosure is not limited thereto. For example, the detection member 52 may have the detection projection 62, as a separate member. In this case, the detection projection 62 is made of an elastic member such as resin film and rubber, for example.

(ix) In the above illustrative embodiment, the idle gear 50 and the toothless gear 51 are rotatably supported to the support shaft 36 of the toner cap 34 mounted to the left sidewall 30, as shown in FIG. 8. However, the disclosure is not limited thereto. For example, the idle gear 50 and the toothless gear 51 may be directly supported to the left sidewall 30. In this case, the left sidewall 30 integrally has the support shaft 36.

(x) In the above illustrative embodiment, as shown in FIG. 8, the idle gear 50 and the toothless gear 51 are rotatably supported to the support shaft 36. However, the disclosure is not limited thereto. For example, the idle gear 50 and the toothless gear 51 may be supported to the guide shaft 74. That is, the guide shaft 74 supports the idle gear 50 and the toothless gear 51, in addition to the detection member 52. In this case, a size of the guide shaft 74 in the left-right direction is greater than the above illustrative embodiment. Also, the toner cap 34 does not have the support shaft 36.

(xi) In the above illustrative embodiment, as shown in FIG. 8, the detection member 52 is supported to the guide shaft 74. However, the disclosure is not limited thereto. For example, the detection member 52 may be supported to the support shaft 36. That is, the support shaft 36 supports the detection member 52, in addition to the idle gear 50 and the toothless gear 51. In this case, a size of the support shaft 36 in the left-right direction is greater than the above illustrative embodiment. Also, the gear cover 39 does not have the guide shaft 74.

(xii) In the above illustrative embodiment, the second agitator gear 46 has the abutment rib 46C and the toothless gear 51 has the boss 57. However, the disclosure is not limited thereto. For example, the second agitator gear 46 may have the boss 57 and the toothless gear 51 may have the abutment rib 46C.

(xiii) In the above illustrative embodiment, the developing roller 2 corresponds to an example of the developer carrier. However, for example, a developing sleeve, a brush-shaped roller and the like may also be applied, instead of the developing roller 2.

(xiv) In the above illustrative embodiment, the detection member 52 is advanced from the retreat position to the advance position, is retreated once and is then again advanced to the advance position. In the respective advance operations, the movement distances of the detection member 52 may be the same or may be all different.

Also, during one advancing and retreating operation, the movement amount of the detection member 52 during the advancing operation and the movement amount of the detection member 52 during the retreating operation may be different.

In the above illustrative embodiment, the detection projection 62 is completely accommodated in the gear cover 39 when the detection member 52 is located at the retreat position. However, the detection projection 62 may slightly protrude from the gear cover 39 when the detection member 52 is located at the retreat position.

In the above illustrative embodiment, the pair of sidewalls 30 of the developing frame 5 extends in the front-rear direction, respectively. However, at least one of the pair of sidewalls 30 may extend in a direction inclined relative to the front-rear direction.

In the above illustrative embodiment, the idle gear support shaft 31 is integrally provided to the sidewall 30 of the developing frame 5. However, the idle gear support shaft 31 may be configured as a separate member from the developing frame 5.

In the above illustrative embodiment, the support shaft (not shown) supporting the developing coupling 41 is integrally provided to the sidewall 30 of the developing frame 5. However, the support shaft (not shown) supporting the developing coupling 41 may be configured as a separate member from the developing frame 5.

Also in the above modified embodiments, it is possible to accomplish the same operational effects as the illustrative embodiment. In the meantime, the above illustrative embodiment and modified embodiments may be combined with each other.

The disclosure provides illustrative, non-limiting aspects as follows:

According to an aspect of the disclosure, there is provided a cartridge including a housing configured to accommodate therein developer, a driving receiving part configured to receive a driving force, a first rotary member configured to rotate by a driving force transmitted from the driving receiving part, a conveyance member to which a driving force is configured to be transmitted by rotation of the first rotary member and configured to convey the developer, a second rotary member configured to rotate by a driving force transmitted from the driving receiving part, and a detected part configured to move by the rotation of the second rotary member, wherein the second rotary member is arranged to overlap with the first rotary member in an axis direction parallel with an axis of the first rotary member.

According to the above configuration, the first rotary member and the second rotary member are rotated by the driving force transmitted from the driving receiving part, respectively. Then, the conveyance member is driven by the driving force transmitted from the first rotary member to convey the developer, and the detected part is moved in accordance with the rotation of the second rotary member and is detected by an external configuration. For this reason, it is possible to enable the external configuration to recognize that an unused cartridge has been mounted.

Also, since the first rotary member and the second rotary member are arranged to overlap with each other in the axis direction, it is possible to reduce a space for arranging the first rotary member and the second rotary member in a direction orthogonal to the axis direction.

For this reason, it is possible to make the cartridge small while enabling the external configuration to recognize that the unused cartridge has been mounted.

In the above cartridge, the first rotary member and the second rotary member may be configured to rotate about the same axis.

According to the above configuration, since the first rotary member and the second rotary member are configured to rotate about the same axis, it is possible to secure the effective arrangement of the first rotary member and the second rotary member, thereby reliably making the cartridge small.

The above cartridge may further include a support part rotatably supporting both the first rotary member and the second rotary member.

According to the above configuration, it is possible to arrange the first rotary member and the second rotary member so that they reliably overlap with each other in the axis direction, with a simple configuration.

In the above cartridge, the conveyance member may be a first agitator configured to stir the developer.

According to the above configuration, since the conveyance member is the first agitator, it is possible to stir the developer accommodated in the housing.

The above cartridge may further include developer carrier configured to carry thereon the developer.

According to the above configuration, the developer carrier can reliably supply the developer to an external photosensitive member.

The above cartridge may further include, a second agitator configured to stir the developer.

According to the above configuration, since the cartridge has the first agitator and the second agitator, it is possible to more reliably stir the developer accommodated in the housing.

The above cartridge may further include a third rotary member configured to transmit a driving force transmitted from the first rotary member to the first agitator, and a fourth rotary member configured to transmit a driving force from the driving receiving part to the first rotary member and to the second agitator. The first rotary member may be arranged between the fourth rotary member and the third rotary member in a driving force transmitting direction from the driving receiving part towards the third rotary member.

According to the above configuration, since the first rotary member is arranged between the fourth rotary member and the third rotary member in the driving force transmitting direction, the fourth rotary member is arranged upstream from the first rotary member in the transmitting direction, and the third rotary member is arranged downstream from the first rotary member in the transmitting direction.

For this reason, it is possible to sequentially transmit the driving force from the driving receiving part to the fourth rotary member, the first rotary member and the third rotary member, while securing the effective arrangement of the first rotary member, the third rotary member and the fourth rotary member. As a result, it is possible to reliably drive the first agitator and the second agitator, respectively.

In the above cartridge, the first agitator and the second agitator may be rotatable in the same phase.

According to the above configuration, since the first agitator and the second agitator are rotated in the same phase, it is possible to suppress the interference between the first agitator and the second agitator during rotations thereof and to effectively stir and convey the developer.

In the above cartridge, the fourth rotary member may be configured to transmit a driving force from the driving receiving part to the second rotary member. The first rotary member may be configured to contact the fourth rotary member over an entire circumference thereof. The second rotary member may include a non-contact part configured not to contact the fourth rotary member when the second rotary member is rotated, and a contact part configured to contact the fourth rotary member when the second rotary member is rotated. The second rotary member may be configured to move from a first position, at which the non-contact part faces the fourth rotary member in a diametrical direction of the second rotary member, to a second position, at which the contact part contacts the fourth rotary member and receives the driving force from the fourth rotary member.

According to the above configuration, since the first rotary member contacts the fourth rotary member over an entire circumference thereof, the first rotary member can always receive the driving force from the fourth rotary member upon the rotation of the fourth rotary member. For this reason, it is possible to always transmit the driving force from the driving receiving part to the third rotary member and further to the first agitator through the first rotary member, so that it is possible to guarantee the reliable driving of the first agitator.

In the meantime, the second rotary member includes a contact part and a non-contact part, and moves from a first position, at which the non-contact part faces the fourth rotary member, to a second position, at which the contact part contacts the fourth rotary member and receives the driving force from the fourth rotary member. For this reason, the second rotary member is moved from the first position, at which the driving force is not transmitted thereto and the rotation thereof is stopped, to the second position, at which the contact part contacts the fourth rotary member and thus receives the driving force from the fourth rotary member, and is thus rotated. As a result, it is possible to rotate the second rotary member and to move the detected part at a desired timing.

In the above cartridge, the fourth rotary member may include a first abutment part. The second rotary member may include a second abutment part configured to be abutted on by the first abutment part. During the rotation of the fourth rotary member, the first abutment part may be configured to move the second rotary member from the first position to the second position by abutting on the second abutment part of the second rotary member located at the first position.

According to the above configuration, during the rotation of the fourth rotary member, the first abutment part moves the second rotary member from the first position to the second position by abutting on the second abutment part of the second rotary member located at the first position. Therefore, it is possible to move the second rotary member from the first position to the second portion at a desired timing.

In the above cartridge, the second rotary member may be arranged at an opposite side of the housing with respect to the first rotary member.

According to the above configuration, since the second rotary member is arranged at the opposite side of the housing with respect to the first rotary member, i.e., at an outer side, it is possible to suppress the interference between the first rotary member and the detected part which is moved as the second rotary member is rotated.

The above cartridge may further include a detected member including the detected part. The detected member may be configured move in the axis direction by receiving the driving force from the second rotary member.

According to the above configuration, since the detected member is moved in the axis direction by the driving force applied from the second rotary member, when the detected part is detected by the external configuration in a state where the detected member is moved to separate from the housing, it is possible to detect the detected part at a position distant from the housing. As a result, it is possible to improve the detection precision.

In the above cartridge, one of the second rotary member and the detected member may have an inclined surface that faces an other of the second rotary member and the detected member in the axis direction and is configured to slide on the other of the second rotary member and the detected member when the second rotary member is rotated. The inclined surface may be inclined to become closer to the second rotary member towards a downstream side of the second rotary member in the rotating direction.

According to the above configuration, when the second rotary member has the inclined surface, the inclined surface of the second rotary member gradually presses the detected member in the axis direction, as the second rotary member is rotated.

Also, when the detected member has the inclined surface, the second rotary member gradually presses the inclined surface of the detected member in the axis direction, as the second rotary member is rotated.

Thereby, it is possible to smoothly move the detected member in the axis direction by the inclined surface provided to one of the second rotary member and the detected member.

In the above cartridge, a portion of the detected member, which overlaps with the fourth rotary member when seen in the axis direction, is notched.

According to the above configuration, during the movement of the detected member, it is possible to suppress the interference between the detected member and the fourth rotary member. Also, it is possible to reduce a space for arranging the detected member and the fourth rotary member, thereby making the cartridge smaller.

In the above cartridge, the detected part may be configured to move while being restrained from moving in the rotating direction of the second rotary member.

According to the above configuration, since the detected part is moved while being restrained from moving in the rotating direction, it is possible to reduce a space for arranging the detected part in the rotating direction. For this reason, it is possible to improve a degree of freedom of the arrangement of the detected part in the rotating direction.

According to the disclosure, it is possible to enable the external configuration to recognize that the unused cartridge has been mounted.

What is claimed is:

1. A cartridge comprising:

a housing configured to accommodate therein developer;

a driving receiving part configured to receive a driving force;

a first rotary member configured to rotate by a driving force transmitted from the driving receiving part;

a conveyance member to which a driving force is configured to be transmitted by rotation of the first rotary member and configured to convey the developer;

a second rotary member configured to rotate by a driving force transmitted from the driving receiving part, the first rotary member being located between the second rotary member and the housing;

a detected part configured to move by the rotation of the second rotary member;

wherein the second rotary member is arranged to overlap with the first rotary member in an axis direction parallel with an axis of the first rotary member, wherein the first rotary member and the second rotary member are configured to rotate about the same axis, and wherein the detected part is configured to move while being restrained from moving in the rotating direction of the second rotary member;

a third rotary member configured to transmit a driving force transmitted from the first rotary member to the first agitator; and a fourth rotary member configured to transmit a driving force from the driving receiving part to the first rotary member and to the second agitator, wherein the second rotary member is arranged to overlap with the first rotary member in an axis direction parallel with an axis of the first rotary member, and wherein the first rotary member and the second rotary member are configured to rotate about the same axis, wherein the detected part is configured to move while being restrained from moving in the rotating direction of the second rotary member, and wherein the first rotary member is arranged between the fourth rotary member and the third rotary member in a driving force transmitting direction from the driving receiving part towards the third rotary member.

2. The cartridge according to claim 1, further comprising:

a support part rotatably supporting both the first rotary member and the second rotary member.

3. The cartridge according to claim 1, wherein the conveyance member is a first agitator configured to stir the developer.

4. The cartridge according to claim 3, further comprising:

a developer carrier configured to carry thereon the developer.

5. The cartridge according to claim 3, further comprising:

a second agitator configured to stir the developer.

6. The cartridge according to claim 1, wherein the first agitator and the second agitator are rotatable in the same phase.

7. The cartridge according to claim 1, wherein the fourth rotary member is configured to transmit a driving force from the driving receiving part to the second rotary member, wherein the first rotary member is configured to contact the fourth rotary member over an entire circumference thereof, wherein the second rotary member includes:

a non-contact part configured not to contact the fourth rotary member when the second rotary member is rotated, and a contact part configured to contact the fourth rotary member when the second rotary member is rotated, and wherein the second rotary member is configured to move from a first position, at which the non-contact part faces the fourth rotary member in a diametrical direction of the second rotary member, to a second position, at which the contact part contacts the fourth rotary member and receives the driving force from the fourth rotary member.

8. The cartridge according to claim 1, wherein the fourth rotary member includes a first abutment part, wherein the second rotary member includes:

a non-contact pail configured not to contact the fourth rotary member when the second rotary member is rotated, and a contact part configured to contact the fourth rotary member when the second rotary member is rotated, and wherein the second rotary member is configured to move from a first position, at which the non-contact part faces the fourth rotary member in a diametrical direction of the second rotary member, to a second position, at which the contact part contacts the fourth rotary member and receives the driving force from the fourth rotary member, wherein the second rotary member includes a second abutment part configured to be abutted on by the first abutment part, and wherein, during the rotation of the fourth rotary member, the first abutment part is configured to move the second rotary member from the first position to the second position by abutting on the second abutment part of the second rotary member located at the first position.

9. The cartridge according to claim 1, further comprising:

a detected member including the detected part, wherein the detected member is configured to move in the axis direction by receiving the driving force from the second rotary member.

10. The cartridge according to claim 9, wherein one of the second rotary member and the detected member has an inclined surface that faces an other of the second rotary member and the detected member in the axis direction and is configured to slide on the other of the second rotary member and the detected member when the second rotary member is rotated, and wherein the inclined surface is inclined to become closer to the second rotary member towards a downstream side of the second rotary member in the rotating direction.

11. The cartridge according to claim 9, wherein a portion of the detected member, which overlaps with the fourth rotary member when seen in the axis direction, is notched.

12. A cartridge comprising:

a housing configured to accommodate developer;

a coupling rotatable about a first rotational axis;

an idle gear rotatable about a second rotational axis in accordance with rotation of the coupling, the idle gear including a first surface facing an outer surface of the housing in an axis direction along the second rotational axis and a second surface opposite to the first surface in the axis direction;

a first agitator for stirring the developer, the first agitator rotatable about a third rotational axis;

a first agitator gear positioned to the first agitator and rotatable about the third rotational axis of the first agitator together with the first agitator in accordance with rotation of the idle gear;

a rotary member rotatable about the second rotational axis of the idle gear in accordance with rotation of the coupling, the rotary member including a third surface facing the second surface of the idle gear in the axis direction; and a detected part movable in accordance with rotation of the rotary member;

a second agitator for stirring the developer, the second agitator rotatable about a fifth rotational axis in accordance with rotation of the coupling; and a second agitator gear positioned to the second agitator, the second agitator gear rotatable about the fifth rotational axis of the second agitator together with the second agitator in accordance with rotation of the coupling;

wherein the idle gear is engaged with the first agitator gear and the seond agitator gear.

13. The cartridge according to claim 12, further comprising a support shaft extending in the axis direction, wherein the idle gear is rotatable around the support shaft and the rotary member is rotatable around the support shaft.

14. The cartridge according to claim 12, further comprising:

a developer roller rotatable about a fourth rotational axis in accordance with rotation of the coupling.

15. The cartridge according to claim 12, wherein the rotary member is a toothless gear configured to be engaged with the second agitator gear.

16. A cartridge comprising:

a housing configured to accommodate developer;

a coupling rotatable about a first rotational axis;

an idle gear rotatable about a second rotational axis in accordance with rotation of the coupling, the idle gear including a first surface facing an outer surface of the housing in an axis direction along the second rotational axis and a second surface opposite to the first surface in the axis direction;

a first agitator for stirring the developer, the first agitator rotatable about a third rotational axis;

a first agitator gear positioned to the first agitator and rotatable about the third rotational axis of the first agitator together with the first agitator in accordance with rotation of the idle gear;

a rotary member rotatable about the second rotational axis of the idle gear in accordance with rotation of the coupling, the rotary member including a third surface facing the second surface of the idle gear in the axis direction;

a detected part movable in accordance with rotation of the rotary member; and a detected member including the detected part, wherein the detected member is movable in the axis direction in accordance with rotation of the rotary member, wherein the rotary member includes a fourth surface opposite to the third surface in the axis direction, wherein the detected member includes:

a fifth surface facing the fourth surface in the axis direction, and an inclined surface protruding from the fifth surface toward the fourth surface in the axis direction, the inclined surface being configured to slide on the rotary member in accordance with rotation of the rotary member.

* * * * *